US006702225B2

(12) United States Patent
Newman et al.

(10) Patent No.: US 6,702,225 B2
(45) **Date of Patent: *Mar. 9, 2004**

(54) DISPENSER AND TRAY FOR PREMOISTENED WIPES

(75) Inventors: William R. Newman, Neenah, WI (US); Herb F. Velazquez, Neenah, WI (US); Jerry P. DeGreen, Windsor, OH (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/302,282

(22) Filed: Apr. 30, 1999

(65) Prior Publication Data

US 2002/0053624 A1 May 9, 2002

(51) Int. Cl.[7] ..... B65H 16/02
(52) U.S. Cl. ..... 242/595; 242/594.1
(58) Field of Search ..... 242/588.3, 588, 242/615.2, 615.4, 595, 594.2, 594.1; 206/409; 221/45, 61, 62, 303

(56) References Cited

U.S. PATENT DOCUMENTS

| | | | |
|---|---|---|---|
| 1,664,392 | A | 4/1928 | Baruch |
| 2,440,974 | A | 5/1948 | Resch |
| 3,310,353 | A | 3/1967 | Cordis |
| 3,368,522 | A | 2/1968 | Cordis |

(List continued on next page.)

FOREIGN PATENT DOCUMENTS

| | | | |
|---|---|---|---|
| EP | 0 122 809 | A1 | 10/1984 |
| EP | 0 501 905 | A1 | 9/1992 |
| WO | WO 96/21388 | A1 | 7/1996 |
| WO | WO 98/08763 | A1 | 3/1998 |
| WO | WO 99/01536 | A1 | 1/1999 |
| WO | WO 99/06311 | A2 | 2/1999 |

OTHER PUBLICATIONS

Kotler, Philip, *Marketing Management*, Prentice Hall, Upper Saddle River, NJ, 2000, pp. 456–483.

Images of Moist Mates product—dispenser and wipes, Copyright 1996, 15 pages.

(List continued on next page.)

*Primary Examiner*—John Q. Nguyen
(74) *Attorney, Agent, or Firm*—Gregory E. Croft; Michael J. Bendel; Scott A. Baum

(57) ABSTRACT

A dispenser for premoistened wipes having a removable tray. The dispenser includes a housing which may include a frame and a cover. The housing defines an interior space in which the premoistened wipes may be placed. A removable tray having a liquid retaining receptacle portion may be positioned below the interior space and wipes. The tray may also include a raised portion having a support surface for the premoistened wipes. The raised portion may be formed by a plurality of ribs, guide rolls or a combination thereof. The tray may also include a grip to facilitate its insertion and removal from the dispenser. The premoistened wipes may be dispensed by passing the wipes through a gap between two dispenser rollers. The dispenser may also include an impingement edge which extends adjacent the two dispensing rollers. The impingement edge has a central portion which is located at a first relative position with respect to the dispenser rollers and two outer portions which are located at relative positions which differ from that of the central portion. The dispenser may also include a support for a roll of conventional dry bathroom tissue.

46 Claims, 22 Drawing Sheets

U.S. PATENT DOCUMENTS 3,532,210 A 10/1970 Minion et al.
3,568,635 A 3/1971 Poitras et al.
3,592,161 A 7/1971 Hoffmann
3,633,838 A 1/1972 Krueger
3,656,699 A 4/1972 Schnyder et al.
3,713,170 A 1/1973 Kaufman
3,729,145 A 4/1973 Koo et al.
3,754,804 A 8/1973 Cushman
3,756,483 A 9/1973 Schraeder
3,771,739 A 11/1973 Nelson
3,775,801 A 12/1973 Walker
3,780,908 A 12/1973 Fitzpatrick et al.
3,784,055 A 1/1974 Anderson
3,788,573 A 1/1974 Thomson et al.
3,795,355 A 3/1974 Gerstein
3,806,055 A 4/1974 Bauman
3,824,953 A 7/1974 Boone
3,836,044 A 9/1974 Tilp et al.
3,836,045 A 9/1974 Duhy et al.
3,837,595 A * 9/1974 Boone ..... 242/595
3,841,466 A 10/1974 Hoffman et al.
3,843,017 A 10/1974 Harrison
3,848,822 A 11/1974 Boone
3,865,271 A 2/1975 Gold
3,890,622 A 6/1975 Alden
3,913,522 A 10/1975 Light
3,949,947 A 4/1976 Youngquist et al.
3,967,756 A 7/1976 Barish
3,970,215 A 7/1976 McLaren et al.
3,982,659 A 9/1976 Ross
3,986,479 A 10/1976 Bonk
3,994,417 A 11/1976 Boedecker
3,995,582 A 12/1976 Douglas
4,002,264 A 1/1977 Marchesani
4,004,687 A * 1/1977 Boone ..... 242/595 X
4,025,004 A 5/1977 Massey
4,043,519 A 8/1977 Suzuki et al.
4,069,789 A 1/1978 Fukagawa et al.
4,071,200 A 1/1978 Stone
4,098,469 A 7/1978 McCarthy
4,101,026 A 7/1978 Bonk
4,106,433 A 8/1978 Fernando et al.
4,106,616 A * 8/1978 Boone ..... 242/595 X
4,106,617 A * 8/1978 Boone ..... 242/595 X
4,114,824 A 9/1978 Danielak
4,124,259 A 11/1978 Harris
4,131,195 A 12/1978 Worrell, Sr.
4,135,199 A 1/1979 Kurland et al.
4,135,678 A 1/1979 Williams
4,138,034 A 2/1979 McCarthy
4,179,078 A 12/1979 Mansfield
4,191,317 A 3/1980 Harkins
4,205,802 A 6/1980 Economakis
4,219,129 A 8/1980 Sedgwick
4,222,621 A 9/1980 Greenlee et al.
4,235,333 A 11/1980 Boone
4,244,493 A 1/1981 Harrison
4,260,117 A 4/1981 Perrin et al.
4,274,573 A 6/1981 Finkelstein
4,294,389 A 10/1981 Falk et al.
4,328,907 A 5/1982 Beard
4,353,480 A 10/1982 McFadyen
4,363,454 A 12/1982 Mohar
4,375,874 A 3/1983 Leotta et al.
4,383,656 A 5/1983 Campbell
4,401,248 A 8/1983 Helms
4,411,374 A 10/1983 Hotchkiss
4,425,012 A 1/1984 Kley
4,427,159 A 1/1984 Miller et al.
4,428,497 A 1/1984 Julius et al.
4,432,504 A 2/1984 Pace
4,436,221 A 3/1984 Margulies
4,447,015 A 5/1984 Peterson
4,453,634 A 6/1984 Blumenthal
4,463,912 A 8/1984 Grunerud
4,467,974 A 8/1984 Crim
4,526,291 A 7/1985 Margulies
4,535,912 A 8/1985 Bonk
4,550,855 A 11/1985 Harrison
4,564,148 A 1/1986 Wentworth
4,566,606 A 1/1986 Kling
4,570,820 A 2/1986 Murphy
4,607,809 A 8/1986 Sineni et al.
4,648,530 A 3/1987 Granger
4,659,028 A 4/1987 Wren
4,662,576 A 5/1987 Paul
4,662,577 A 5/1987 Lewis
4,684,075 A 8/1987 Francis
4,690,345 A 9/1987 Cotey
4,721,264 A 1/1988 Muscarello
4,735,317 A 4/1988 Sussman et al.
4,756,485 A 7/1988 Bastian et al.
4,784,290 A 11/1988 Howard
4,790,490 A 12/1988 Chakravorty
4,807,823 A 2/1989 Wyant
4,826,063 A 5/1989 Ban
4,830,301 A 5/1989 Miller
4,834,316 A 5/1989 DeLorean
4,836,368 A 6/1989 Cotton
4,836,462 A 6/1989 Bruss
4,846,412 A 7/1989 Morand
4,860,893 A 8/1989 Kaufman
D303,890 S 10/1989 Pilot
4,877,133 A 10/1989 Klenter et al.
4,883,197 A 11/1989 Sanchez et al.
4,884,690 A 12/1989 Klenter et al.
4,890,205 A 12/1989 Shaffer
4,913,365 A 4/1990 Shamass
4,936,452 A 6/1990 Pauley
D311,106 S 10/1990 Jaber
4,978,095 A 12/1990 Phillips
4,984,530 A 1/1991 Dutton
4,989,800 A 2/1991 Tritch
4,991,538 A 2/1991 Davids et al.
5,000,393 A 3/1991 Madsen
5,009,313 A 4/1991 Morand
5,012,986 A 5/1991 Needle
5,029,787 A 7/1991 Florentin
5,050,737 A 9/1991 Joslyn et al.
5,104,054 A 4/1992 Latham
5,137,173 A 8/1992 Hughes et al.
5,141,171 A 8/1992 Yang
5,145,091 A 9/1992 Meyers
D329,978 S 10/1992 Ryan
5,154,496 A 10/1992 Campbell et al.
5,170,958 A 12/1992 Brown
5,172,840 A 12/1992 Bloch et al.
5,192,044 A 3/1993 Baskin
5,193,759 A 3/1993 Bigelow et al.
5,195,689 A 3/1993 Beer et al.
5,207,367 A 5/1993 Dunn et al.
5,219,092 A 6/1993 Morand
5,228,632 A 7/1993 Addison et al.
5,253,818 A 10/1993 Craddock
5,255,800 A 10/1993 Kelly
D342,635 S 12/1993 Carter et al.
D342,852 S 1/1994 Welch
5,277,375 A 1/1994 Dearwester
5,310,262 A 5/1994 Robison et al.
5,311,986 A 5/1994 Putz
D347,534 S 6/1994 Gottselig 5,335,811 A 8/1994 Morand
5,368,157 A 11/1994 Gasparrini et al.
5,370,336 A 12/1994 Whittington
5,374,008 A 12/1994 Halvorson et al.
5,392,945 A 2/1995 Syrek
5,400,982 A 3/1995 Collins
5,409,181 A 4/1995 Patrick
5,439,521 A 8/1995 Rao
5,443,084 A 8/1995 Saleur
5,449,127 A 9/1995 Davis
D362,773 S 10/1995 Kartchner
5,456,420 A 10/1995 Frazier
5,456,421 A 10/1995 Reed
5,464,170 A 11/1995 Mitchell et al.
5,480,060 A 1/1996 Blythe
5,494,250 A 2/1996 Chen
5,495,997 A 3/1996 Moody
5,509,593 A 4/1996 Bloch et al.
5,526,973 A 6/1996 Boone et al.
5,533,621 A 7/1996 Schoal, Jr.
5,542,568 A 8/1996 Julius
5,560,514 A 10/1996 Frazier
5,588,615 A 12/1996 Batts
D377,284 S 1/1997 Farrow et al.
5,598,987 A 2/1997 Wachowicz
5,604,992 A 2/1997 Robinson
5,605,250 A 2/1997 Meiron et al.
5,618,008 A 4/1997 Dearwester et al.
5,624,025 A 4/1997 Hixon
5,630,526 A 5/1997 Moody
5,630,563 A 5/1997 Meisner et al.
5,642,810 A 7/1997 Warner et al.
5,649,676 A 7/1997 Lord
D381,851 S 8/1997 Sharpe
5,653,403 A 8/1997 Ritchey
5,655,661 A 8/1997 Rigby
5,660,313 A 8/1997 Newbold
5,660,636 A 8/1997 Shangold et al.
5,667,092 A 9/1997 Julius et al.
5,669,576 A 9/1997 Moody
5,672,206 A 9/1997 Gorman
D386,025 S 11/1997 Mervar et al.
5,687,875 A 11/1997 Watts et al.
D387,590 S 12/1997 Cameron et al.
5,697,576 A 12/1997 Bloch et al.
5,697,577 A 12/1997 Ogden
5,704,565 A 1/1998 Cheng
5,704,566 A 1/1998 Schutz et al.
5,765,717 A 6/1998 Gottselig
D397,265 S 8/1998 Badillo
RE35,976 E 12/1998 Gasparrini et al.
5,848,762 A 12/1998 Reinheimer et al.
5,868,275 A 2/1999 Moody
5,868,335 A 2/1999 Lebrun
5,868,344 A 2/1999 Melnick
5,868,345 A 2/1999 Beisser
5,868,346 A 2/1999 Cobos
5,868,347 A 2/1999 Paul et al.
5,887,759 A 3/1999 Ayigbe
5,887,818 A 3/1999 Kelley
5,893,531 A 4/1999 Taylor et al.
5,897,074 A 4/1999 Marino
5,901,921 A 5/1999 Perlsweig
5,904,316 A * 5/1999 Dunning et al. ..... 242/595
5,924,617 A 7/1999 LaCount et al.
D412,439 S 8/1999 Cormack
5,938,013 A 8/1999 Palumbo et al.
5,950,960 A * 9/1999 Marino ..... 242/594.2 X
5,951,762 A 9/1999 Shangold et al.
5,967,452 A 10/1999 Wilder
5,971,138 A 10/1999 Soughan
5,971,142 A 10/1999 Jones
D416,794 S 11/1999 Cormack
D417,109 S 11/1999 Johnson et al.
5,979,821 A 11/1999 LaCount et al.
D417,987 S 12/1999 Velazquez
6,000,538 A 12/1999 Lee
6,000,658 A 12/1999 McCall, Jr.
6,007,019 A 12/1999 Lynch
6,015,125 A 1/2000 Fischer
6,024,323 A 2/2000 Palermo, Jr.
D421,691 S 3/2000 Hoblitz
6,036,134 A 3/2000 Moody
D422,437 S 4/2000 Conran et al.
6,047,920 A 4/2000 Dearwester et al.
6,056,233 A 5/2000 Von Schenk
6,056,235 A 5/2000 Brozinsky
6,059,882 A 5/2000 Steinhardt et al.
6,068,118 A 5/2000 Calloway
6,079,603 A 6/2000 Smegal
6,085,899 A 7/2000 Thorsbakken
6,092,690 A 7/2000 Bitowft et al.
6,092,758 A 7/2000 Gemmell
6,092,759 A 7/2000 Gemmell et al.
6,098,836 A 8/2000 Gottselig
6,273,359 B1 * 8/2001 Newman et al. ..... 242/595

OTHER PUBLICATIONS

Images of Moist Mates product—dispenser, Copyright 2000, 13 pages.

Images of Moist Mates—refill wipes, Copyright 2000, 11 pages.

Derwent World Patent Database abstract of DE 3133237: Description of M. Scheepe, "Refill Pack of Moisture–Impregnated Tissues."

Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand."

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder."

* cited by examiner

DISPENSER AND TRAY FOR PREMOISTENED WIPES

BACKGROUND OF THE INVENTION

The present invention relates to dispensers and, more specifically, to a dispenser for premoistened wipes.

The use of premoistened wipes is well known. Such premoistened wipes are commonly used with small children and infants when replacing soiled diapers. Premoistened wipes are also used to provide a convenient and effective cleaning material in the absence of running water. Premoistened wipes are also used as a replacement for, or supplement to, dry bathroom tissue.

Premoistened wipes may be supplied in individual packages or supplied in larger quantities. While individually supplied wet wipes are typically provided in disposable packaging, larger quantities of wipes may be supplied in either disposable or re-useable containers. Two common containers for supplying multiple wipes are resealable bags and tubs. The resealable bags often have a "zippered" opening which has a pair of interlocking profiles which may be re-engaged to seal the bag after removing one or more wipes from the bag. Tubs are also common and often have a lid which allows access to a stack of folded wipes when the lid is in an open position.

SUMMARY OF THE INVENTION

The present inventors have recognized difficulties and problems inherent in the prior art and in response thereto have developed an improved dispenser for premoistened wipes.

In one aspect, the present invention provides a dispenser for premoistened wipes which comprises, i.e., includes but is not limited to, a housing having an interior space in which one or more premoistened wipes may be placed and a removable tray. The removable tray has a liquid retaining receptacle portion which is positionable below the interior space of the housing.

The tray may also include a raised portion having a support surface for the premoistened wipes. The raised portion may be formed by a plurality of ribs. A roller may be used instead of, or in addition to, the ribs to form the raised portion having a support surface.

The tray may include a pair of oppositely disposed side walls which are connected by a lower surface, a laterally extending wall, and a roller located opposite the laterally extending wall whereby a substantial portion of the lower surface is disposed between the roller and the laterally extending wall.

The tray may also include a laterally extending arcuate surface which projects from the tray to form a grip.

The dispenser may also include two dispenser rollers which are cooperatively positioned to engage a premoistened wipe therebetween. One of the dispenser rollers may be located on the removable tray and the other dispenser roller can be located on a cover which has an open and closed position. Engagement surfaces may be used to properly align the two dispenser rollers when the cover is in a closed position.

The dispenser may further include a support which is insertable into the hollow core of a rolled product such as a roll of conventional dry bathroom tissue. The dispenser may also include a mounting device which mounts the dispenser to the oppositely disposed recesses of conventional bathroom tissue fixtures.

In another aspect, the present invention provides a dispenser for premoistened wipes which includes a housing having an interior space in which the wipes may be positioned, and a removable tray having an impermeable lower surface positionable below the interior space in which the premoistened wipes are placed.

In yet another aspect, the present invention provides a dispenser for premoistened wipes which includes a housing having an interior space, a removable tray having a lower surface with a raised portion defining a support surface, and a plurality of premoistened wipes positioned on the support surface within the interior space. The tray may be configured to allow the tray and wipes to be inserted into the housing as a single unit.

One advantage provided by the present invention is that the use of a removable tray facilitates the cleaning of the tray and dispenser. The removal of the tray allows the tray to be conveniently cleaned such as by placing the tray under running water.

Another advantage provided by the present invention is that it provides a convenient method for dispensing premoistened wipes provided in a rolled form. Furthermore, by using a coreless roll of premoistened wipes, the present invention provides a compact dispenser for dispensing premoistened wipes.

In those embodiments of the present invention wherein the tray has a receptacle portion or a liquid impermeable lower surface, the ability to remove the tray from the dispenser facilitates the disposal of excess solution which may run off the wipes and collect in the tray.

A further advantage of the present invention is that the use of a removable tray provides a convenient method of placing premoistened wipes in the dispenser. This is accomplished by placing the premoistened wipes on the tray and then inserting the tray and wipes into the dispenser as a single unit.

These and other advantages of the present invention are provided by its various aspects, individually and in combinations thereof.

BRIEF DESCRIPTION OF THE DRAWINGS

The invention will be more fully understood and further advantages will become apparent when reference is made to the following description of the invention and the accompanying drawings, in which.

Figure 1:
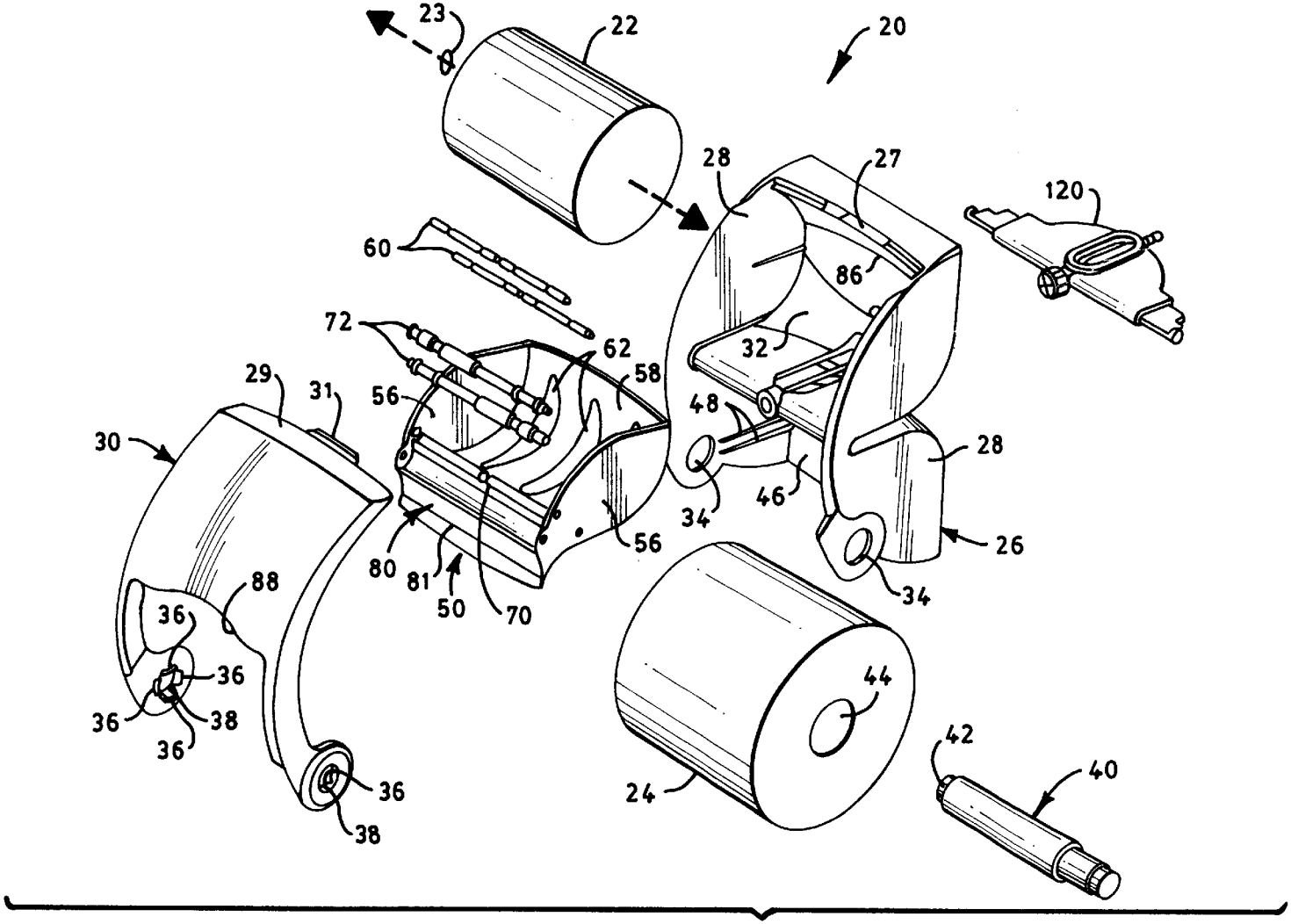
FIG. 1 is an exploded view of a dispenser in accordance with the present invention.

Corresponding reference characters indicate corresponding parts throughout the several views. The disclosed embodiments are set forth to illustrate and exemplify the invention. The disclosed embodiments are not intended to be an exhaustive illustration of the invention or to be construed as limiting the scope of the invention to the precise forms disclosed.

DESCRIPTION OF THE INVENTION

Figure 2:
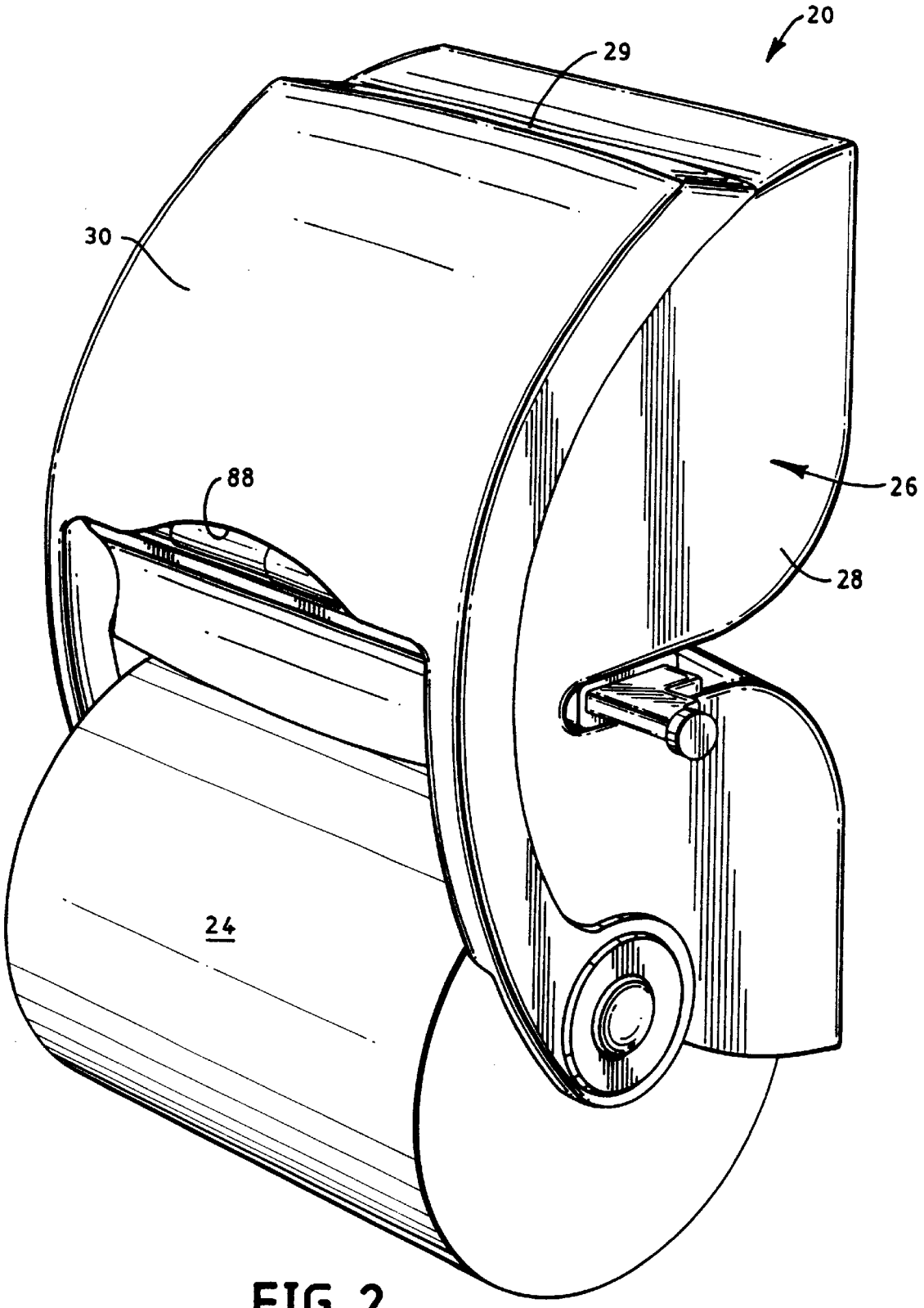
FIG. 2 is a perspective view of the dispenser of FIG. 1.
Figure 16:
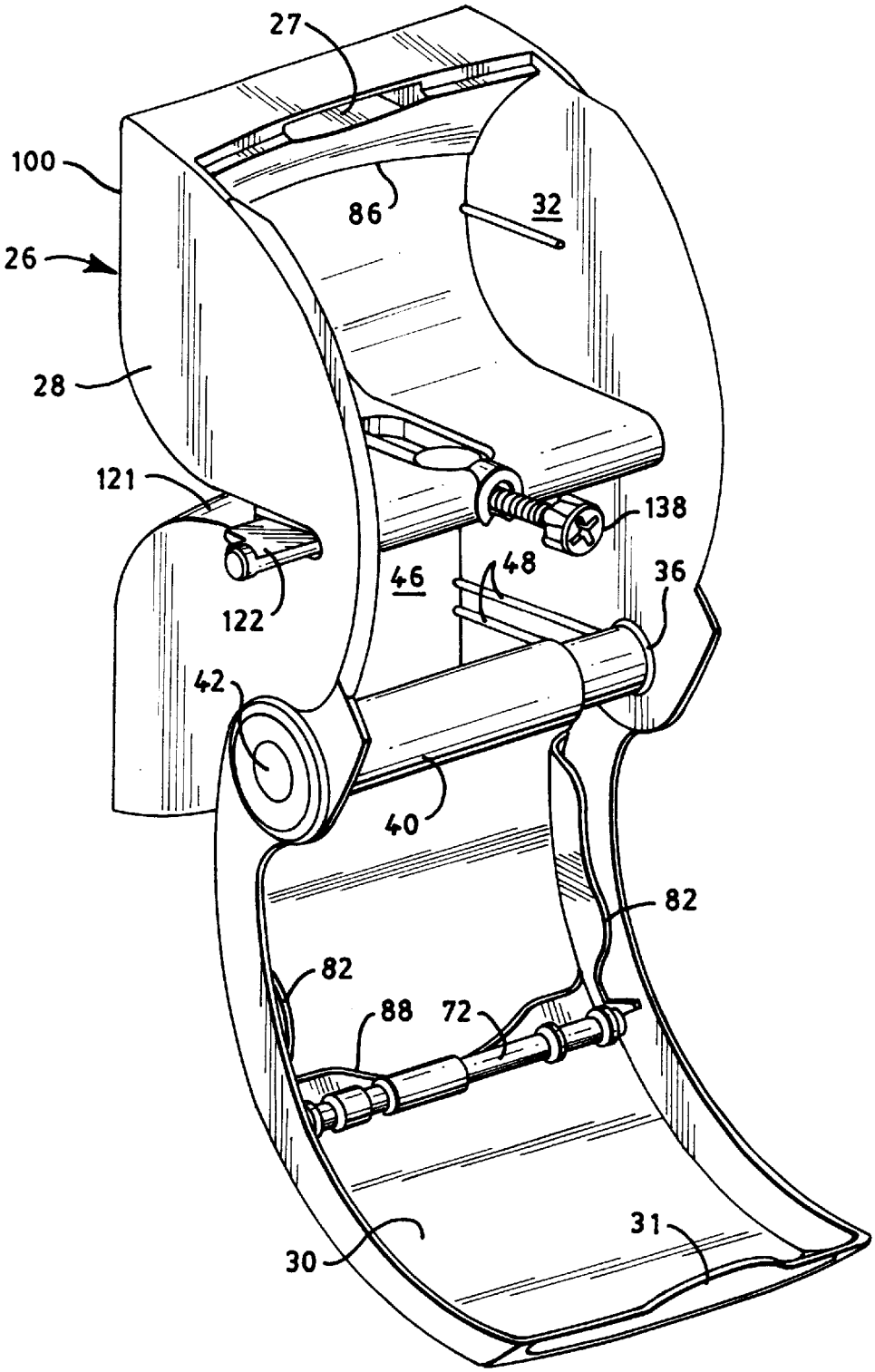
FIG. 16 is a perspective view of a dispenser housing and a mounting device.

FIG. 1 illustrates one representative embodiment of the present invention in an exploded view. As can be seen in FIG. 1, the illustrated dispenser 20 can be used to provide either or both premoistened wipes 22 and conventional dry bathroom tissues 24. The illustrated dispenser has a housing 26 with a frame 28 and a cover 30. Together the frame 28 and cover 30 enclose and define an interior space 32 when the cover is in a closed position as shown in FIG. 2. The cover 30 is shown in an open position in FIGS. 12 and 16.

The cover 30 is attached to the frame 28 at two circular apertures 34 in the frame 28. The cover 30 includes a plurality of projections 36 which are inserted inwardly through the apertures 34 to rotatably mount the cover 30 to the frame 28. The projections 36 provide a bearing surface for engagement with the interior surface of the apertures 34 whereby the cover 30 may be rotated between an open position and a closed position. Some or all of the projections 36 may include outwardly extending tangs at their distal ends which engage the inner surface of the frame 28 adjacent the apertures 34 and thereby inhibit the disengagement of the cover 30 and the frame 28.

The radially inward surfaces 38 of the projections 36 define an opening which is configured to receive the recessed end portions 42 of a telescoping roll bar 40. Telescoping roll bar 40 provides a support which is insertable into the hollow core 44 of a roll of dry bathroom tissue 24 in a conventional manner. The illustrated roll bar 40 has a female member which extends for approximately ¾ of the total length of the support to prevent the bar from tilting. The male and female members of the roll bar 40 remain assembled when removed from the dispenser 20 and include an internal spring selected to have a force which does not distort the housing frame 28. The ends of the roll bar 40 define a curved surface to provide an outward button-like appearance to the ends of the roll bar 40 and to facilitate the removal of the roll bar 40. The telescoping members of the roll bar 40 may be advantageously made of the same materials as the frame 28 and have a matching color.

Alternative supports which are insertable into the hollow core 44 of a rolled tissue product 24 and allow the rotation of the rolled tissue 24 thereon, such as alternative telescoping roll bars, a freely extending cylindrical or J-shaped projection, are also well known and may be combined with the housing 26 to provide for the dispensing of a dry rolled tissue product.

The illustrated frame 28 includes a lower space 46 in which a portion of the dry bathroom tissue 24 is located after the dry tissue 24 is mounted on the roll bar 40. As can be seen in FIG. 1, the frame 28 may also include reinforcing ribs 48 which both provide strength to the frame 28 and help the user of the dispenser 20 to locate the apertures 34 when installing the roll bar 40.

The illustrated cover 30 also includes a recessed portion 29 which allows the cover to be easily grasped when opening the cover 30. Adjacent the recessed portion 29, a latching projection 31 extends from the cover and is received by recess 27 located in the frame 28. The latching projection 31 may engage the recess 27 with an interference or snap fit relationship whereby the engagement of the latching projection 31 with the recess 27 maintains the cover 30 in a closed position. Downward pressure on recessed portion 29 disengages the projection 31 and recesses 27 to allow the cover 30 to be opened. The recessed portion 29 may advantageously employ a different surface texture or color adjacent the latching projection 31 to indicate where pressure should be applied to open the cover 30. The illustrated recess 27 is positioned to be generally hidden from view when the cover 30 is in a closed position. A large variety of different methods and mechanisms for retaining a cover to a frame are known and may be substituted for the illustrated latching method.

The cover 30 may be advantageously formed out of material which permits a user of the dispenser to determine the amount of premoistened wipes remaining in the interior space 32 without opening the cover 30. Alternatively, a small portion of the cover 30 may be clear or partially clear to permit an external visual determination of the amount of premoistened wipes 22 which remain in the interior space 32. The cover 30 may be advantageously formed by an injection molding process using a polycarbonate material.

The illustrated dispenser 20 also includes a removable tray 50. The tray 50 includes a liquid retaining receptacle portion 52 which faces upward when the tray is placed within the dispenser 20. When positioned in the dispenser 20, the tray 50 defines the lower boundary of the interior space 32 in which the premoistened wipes 22 are placed. The tray 50 may be removed by merely opening the cover 30 without dismounting the frame 28.

The liquid retaining receptacle portion 52 of the illustrated embodiment is formed by an impermeable lower surface 54 and several upwardly extending walls which define a volume at the lower portion of the tray 50. The receptacle portion 52 of the tray collects excess solution from the premoistened wipes 22 and thereby prevents the excess solution from soiling or wetting the other components of the dispenser or the dry tissue 24 supported by the dispenser 20. Any excess solution remaining in the receptacle portion 52 after depleting the premoistened wipes 22 can be easily discarded by removal of the tray 50.

The removability of the illustrated tray 50 also facilitates the reuse of the tray 50 by allowing the tray 50 to be removed for cleaning. For example, the tray 50 may be conviently rinsed out in a bathroom sink. Additionally, by manufacturing the removable tray 50 entirely out of materials which are resistant to hot water having a temperature of approximately 180–210° F. (82–99° C.), the tray may be cleaned by placing it in a dishwasher. To facilitate the cleaning and disinfecting of the tray and other dispenser components, it is also advantageous that the materials used to form the tray and other components be resistant to isopropol alcohol, or solutions containing up to 70% isopropol alcohol, and be capable of withstanding disinfecting irradiation. The tray and other dispenser components may be advantageously formed by an injection molding process using an acrylonitrile butadiene styrene (ABS), polycarbonate, polypropylene, acetal or similar material. Those having ordinary skill in the art will recognize that these parts may be formed using a variety of alternative known materials and manufacturing techniques, e.g., machining.

Figure 9:
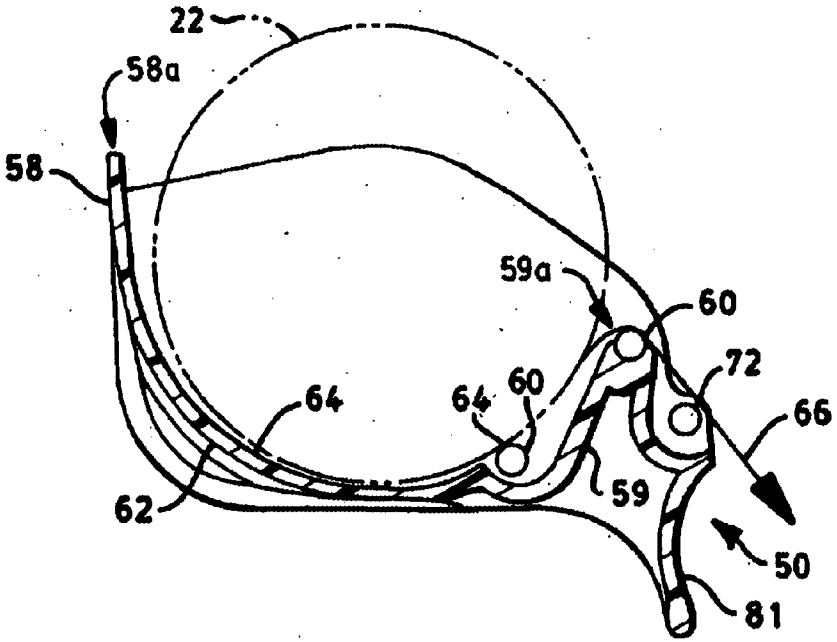
FIG. 9 is a cross sectional view of the tray taken along line A—A of FIG. 6.

When a roll of premoistened wipes 22 is placed in the tray 50 as shown in dashed outline in FIG. 9, the solution contained within the wipes may migrate downwards possibly leaving the wipes located on the upper portion of a stationary roll 22 with less moisture. The dispensing of the wipes, however, will cause the roll 22 to rotate within the tray and the solution retained by the receptacle portion 52 of the tray 50 will enhance the rewetting of the entire roll as it rotates within the tray.

The use of a tray having an impermeable lower surface 54 which is positioned below the wipes 22 and which does not form a liquid retaining receptacle can inhibit the soiling or wetting of the other components of the dispenser provided that the wipes are not overly saturated with solution. The use of a tray 50 which does include a liquid retaining receptacle portion 52, however, will generally be more advantageous.

In the illustrated embodiment, a pair of oppositely disposed side walls 56 are connected by the lower surface 54 and a laterally extending wall 58. The illustrated side walls 56 are spaced at a distance of 4.6 inches (11.68 cm) to provide 0.05 inches (0.13 cm) of clearance on each side of a roll 22 having an axial length of 4.5 inches (11.43 cm). The shape and size of the walls 56, 58 also permits the tray 50 to be tipped when inserting the tray 50 and a roll of premoistened wipes 22 into the dispenser without having the roll 22 fall from the tray 50.

The lower surface 54 includes a raised portion having a support surface 64. The premoistened wipes are placed within the interior space 32 on the support surfaces 64. The illustrated support surfaces 64 are located on the upper surface of ribs 62 and on two laterally extending rollers 60.

Figure 8:
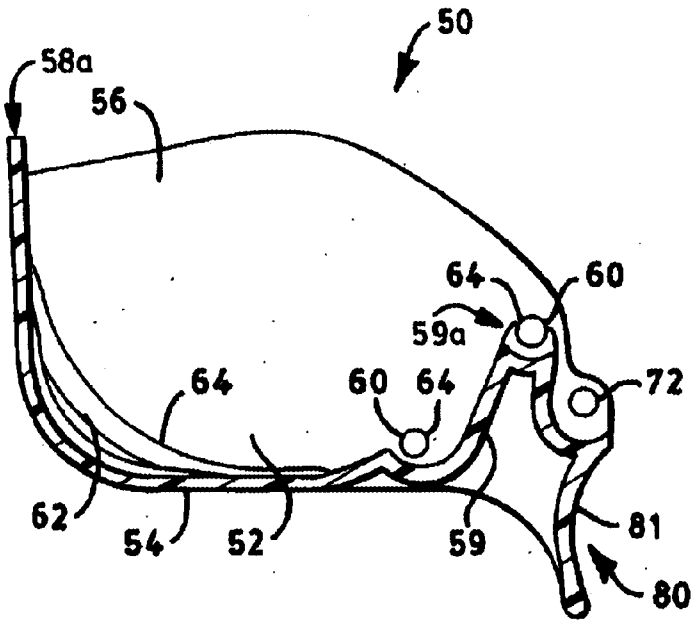
FIG. 8 is a cross sectional view of the tray taken along line B—B of FIG. 6.

A relatively small laterally extending wall 59 is located between the two rollers 60 opposite wall 58. As exemplified by walls 58, 59, a receptacle portion 52 may be provided with walls which extend in a generally upwards direction when the tray 50 is installed in the dispenser 20. In other words, the walls are not required to be oriented perpendicularly to the lower surface 54 or define a vertical plane. Referring to, e.g., FIGS. 8 and 9, wall 58 can be referred to as back wall 58, which has a back top surface 58*a*. Wall 59 can be referred to as front wall 59, which has a front top surface 59*a*.

The two laterally extending rollers 60 are disposed opposite the laterally extending wall 58 whereby a substantial portion of the lower surface 54 is disposed between the roller 60 and the laterally extending wall 58. The premoistened wipes are supported by the ribs 62 in the central portion of the tray 50 while the two rollers 60 provide support at the dispensing end of the tray 50. FIG. 9 includes an arrow 66 which illustrates a path along which the premoistened wipes may be dispensed as they are unwound from roll 22.

As best seen in FIG. 1, the premoistened wipes placed in the tray 50 may be a coreless roll of premoistened wipes 22 having an axis 23. The premoistened wipes 22 advantageously have perforations extending parallel to the axis 23 and separating individual sheets of the rolled premoistened material to enable one or more sheets of the material to be conveniently separated from the remainder of the roll. The absence of a hollow core allows more wipes to be provided for a given roll diameter and eliminates the need for a disposable core. Alternative forms of premoistened wipes may also be used with a dispenser having a removable tray. For example, a stack of flat or folded individual or interconnected wipes or a roll of wipes having a core may also be used.

In the illustrated tray 50, the ribs 62 are oriented substantially perpendicular to the axes of the freely rotatable rollers 60 and the axis 23 of the roll of premoistened wipes 22. By providing ribs 62 having relatively thin support surfaces 64 oriented perpendicular to the axis 23 of the wipes 22, the surface area of the wipes in contact with the support surfaces 64 is minimized. The minimal bearing surface area provided by the ribs 62 allows the wipes 22 to be rotated thereon without excessive frictional resistance. The ribs 62 may also extend upwardly along a portion of the laterally extending wall 58 as shown in the illustrated embodiment. By extending the ribs 62 upwardly along the wall 58, the ribs 62 space the roll 22 from the wall 58 to minimize the area of contact, and frictional forces, between the interior of tray 50 and the roll 22.

Figure 4:
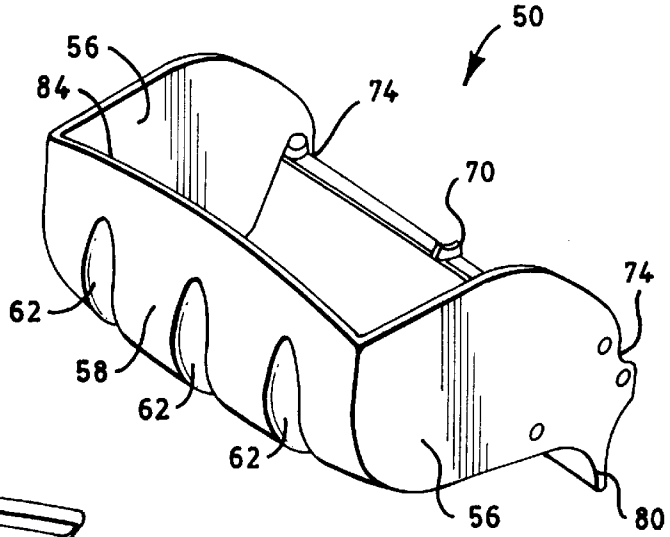
FIG. 4 is another perspective view of the tray.
Figure 5:
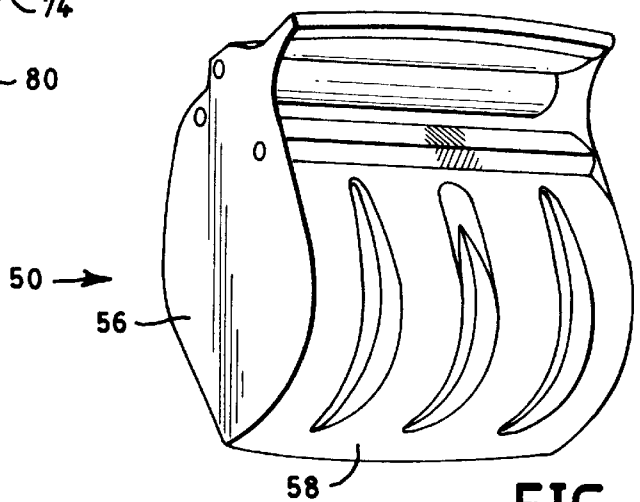
FIG. 5 is another perspective view of the tray.
Figure 3:
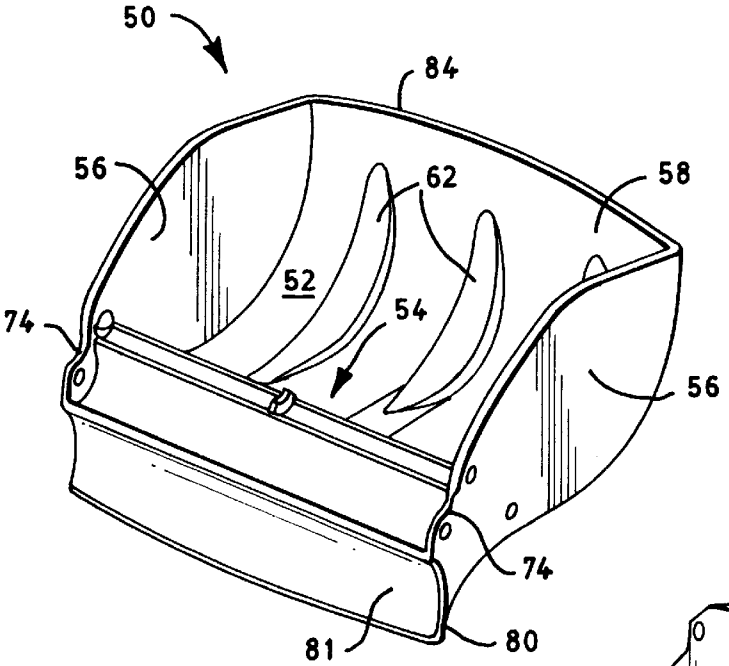
FIG. 3 is a perspective view of the t ray of FIG. 1.
Figure 6:
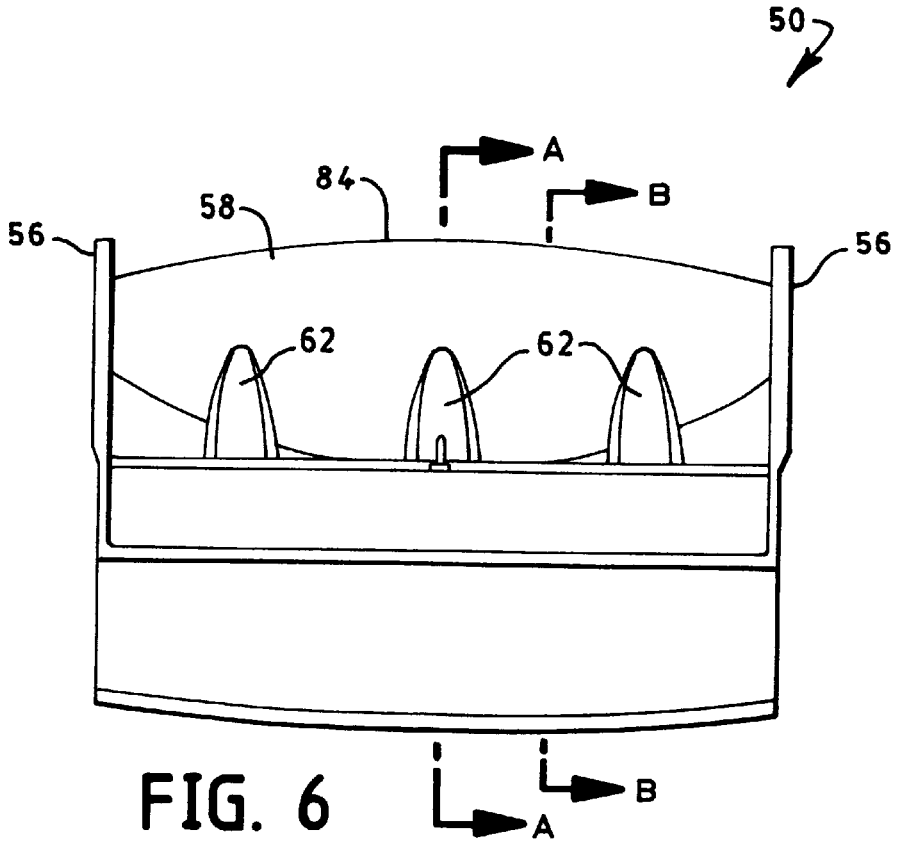
FIG. 6 is front view of the tray.
Figure 7:
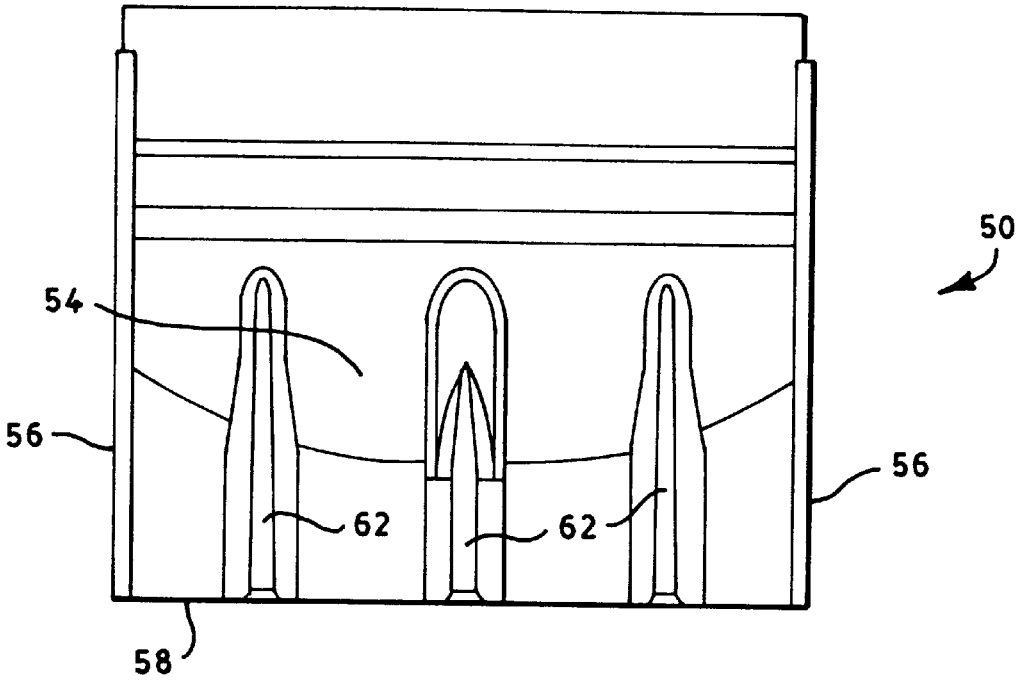
FIG. 7 is a bottom view of the tray.
Figure 12:
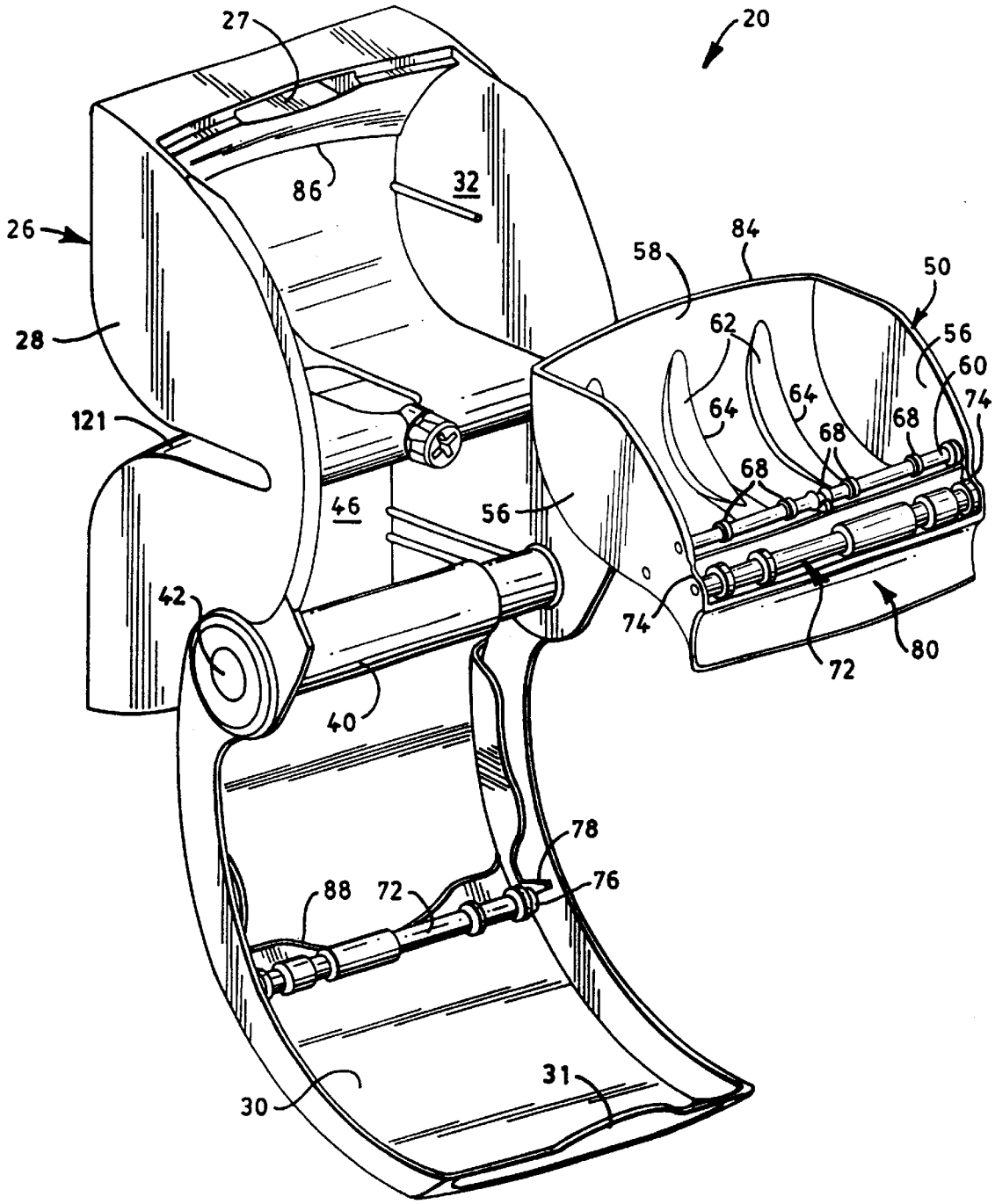
FIG. 12 is an exploded view of a tray and dispenser housing.

The two rollers 60 are generally cylindrical with several spaced, cylindrical lands 68 having an increased diameter which provide support surfaces 64. The intermediate sections of rollers 60 which extend between lands 68 may also engage and support the premoistened wipes. The rollers 60 are rotatably supported by the tray 50 by inserting the ends of the rollers 60 into round apertures in the side walls 56. An intermediate support 70 is also provided for rotatably supporting one of the two rollers 60 as best seen in FIGS. 4 and 12.

The rollers 60 are disposed substantially parallel to the axis 23 of the rolled premoistened wipes 22 and are advantageously positioned to engage and support the rolled wipes near the side of the roll 22 from which wipes are being dispensed. As most easily seen with reference to FIG. 9, the roll of wipes 22 may be unwound by a user pulling the leading wipe which will move along the path indicated by the direction of line 66. As the leading wipe is being dispensed, the roll will be rotated and be pulled towards the rollers 60. The use of freely rotating rollers 60 provides a support for the roll 22 which enables the roll 22 to rotate with minimal frictional resistance.

A combination of both rollers 60 and ribs 62 are used in the illustrated tray 50 to provide a raised portion having a support surface and facilitate the rotation of the roll 22 within the tray 50. Alternative configurations for use with a roll of wipes 22, however, are also possible. For example, the roll 22 could be supported entirely by stationary support surfaces or rollers 60 and the stationary support surfaces or rollers could vary from those shown in the illustrated embodiment.

To load the tray with wipes, the premoistened wipes are positioned above the lower surface 54 and inward of the walls 56, 58. The wipes are conveniently placed into the tray 50 after first removing the tray 50 from the frame 28. Once the wipes have been placed in the tray 50 and the leading wipe draped over the dispensing roller 72, the tray 50 and wipes 22 are then inserted into the interior space 32 as a single unit. Alternatively, the wipes 22 may be placed in the tray 50 while the tray is within the interior space 32.

After inserting the tray 50 and wipes 22, the cover 30 is closed whereby the leading wipe is engaged between the two dispensing rollers 72. One of the dispensing rollers 72 is located on the tray 50 and the second dispensing roller 72 is located on the cover 30. To ensure the proper positioning of the two dispensing rollers 72 when the cover 30 is placed in a closed position, the tray has a pair of engagement surfaces 74 located near the opposite lateral ends of the dispensing roller 72 located on the tray 50. The engagement surfaces 74 located on the tray 50 are engaged by a second pair of engagement surfaces 76 located on the cover 30 near the opposite lateral ends of the dispensing roller 72 located on the cover 30 (FIGS. 12 and 17).

Figure 17:
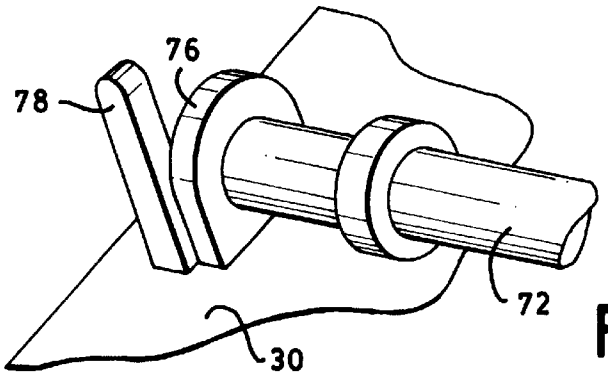
FIG. 17 is a partial perspective view of a dispensing roller.

FIG. 17 is an enlarged view of one of the lateral ends of the dispensing roller 72 located on the cover 30 and shows one of the engagement surfaces 76. The two pairs of engagement surfaces 74, 76 are engaged together when the cover 30 is placed in the closed position to facilitate the proper alignment of the two dispensing rollers 72. Also shown in FIG. 17 is a lateral alignment guide 78. The side walls 56 of the tray 50 are located between the two lateral alignment guides 78 when the cover 30 is closed and the two pair of engagement surfaces 74, 76 are engaged. The guides 78 thereby prevent relative lateral movement between the cover 30 and the tray 50 and facilitate the proper lateral alignment of the two dispensing rollers 72.

In addition to the engagement surfaces 74, 76 which are located above the tray's dispensing roller 72, the cover 30 and tray 50 also include another set of engagement surfaces on the opposite, lower side of the tray's dispensing roller 72. The tray 50 includes a grip 80 which defines a laterally extending arcuate surface 81 which is engageable at its lateral ends by projections 82 on the cover 30. The arcuate surface 81 and projections 82 thereby facilitate the proper alignment of the cover 30 and the tray 50 and the dispenser rollers 72 located thereon.

The grip 80 is positioned so that it may be used when inserting or removing the tray 50 from the dispenser 20. The illustrated grip 80 not only provides a thin, easily gripped projection but the portion of the illustrated grip 80 which forms the exterior surface 81 which is visible when the dispenser is in a closed position also contributes to the aesthetic outward appearance of the dispenser 20 and conceals the threaded fastener 138.

In addition to the engagement of the grip 80 and the projections 82, the tray 50 may also be held in place by the engagement of the top edge 84 of wall 58 with a notch 86 in the interior surface of the frame 28. The engagement of edge 84 and notch 86 prevents the tray 50 from tipping forward as the leading wipe is being pulled during the dispensing process. The use of an arcuate edge 84 and notch 86, which are horizontally as well as vertically engageable, also helps to laterally locate the tray 50 within the frame 28. The top edge 84 may alternatively have a key, such as an upstanding tab, or key-way engageable with either a key-way or key on the frame 28 to securely position the tray 50 within the frame 28.

After inserting the tray 50 and wipes 22 into the dispenser, the wipes may be dispensed by pulling the leading wipe and separating a length of premoistened wipes from the remainder of the roll 22 by tearing the wipe material along a row of perforations separating the individual wipes. The removal of the wipes leaves a new leading wipe engaged between the dispenser rollers 72. The dispensing process may be repeated until the supply of wipes in the tray is depleted whereupon the tray 50 may be removed from the dispenser 20 and the wipes replenished.

Figure 30:
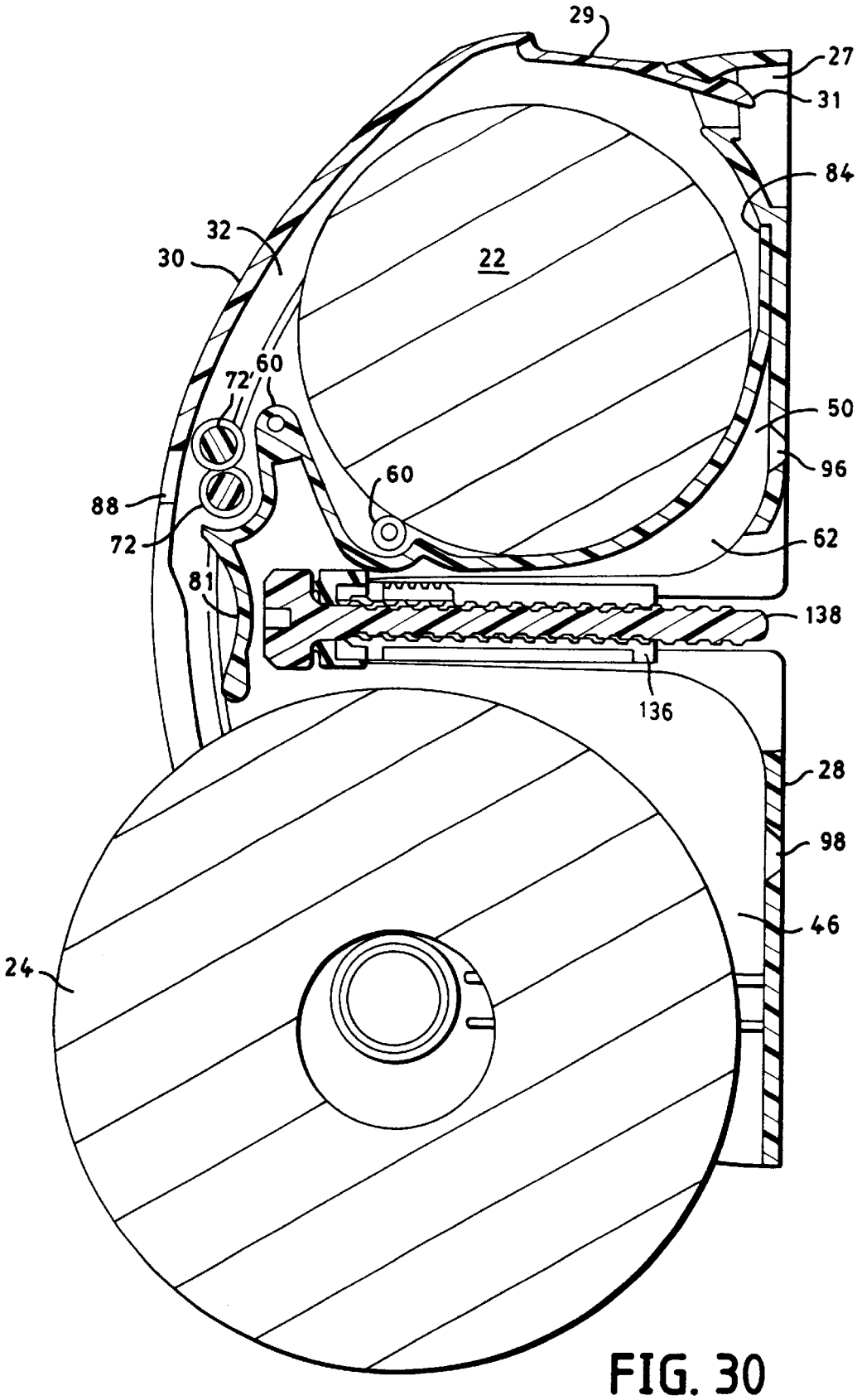
FIG. 30 is a cross sectional view taken along line 30—30 of FIG. 26.

A dispenser 21 which does not include projections 82 for engaging grip 80 is illustrated in FIGS. 25–30. FIG. 30 presents a cross sectional view taken along line 3030 of FIG. 26 and illustrates the tray 50 positioned within interior space 32. Also illustrated in FIG. 30 is the relationship between the dispensing rollers 72 and the impingement surface 88 of the exemplary embodiment. The impingement surface 88 is formed by an edge of the cover 30 and defines an edge of a dispensing opening 89.

Figure 11:
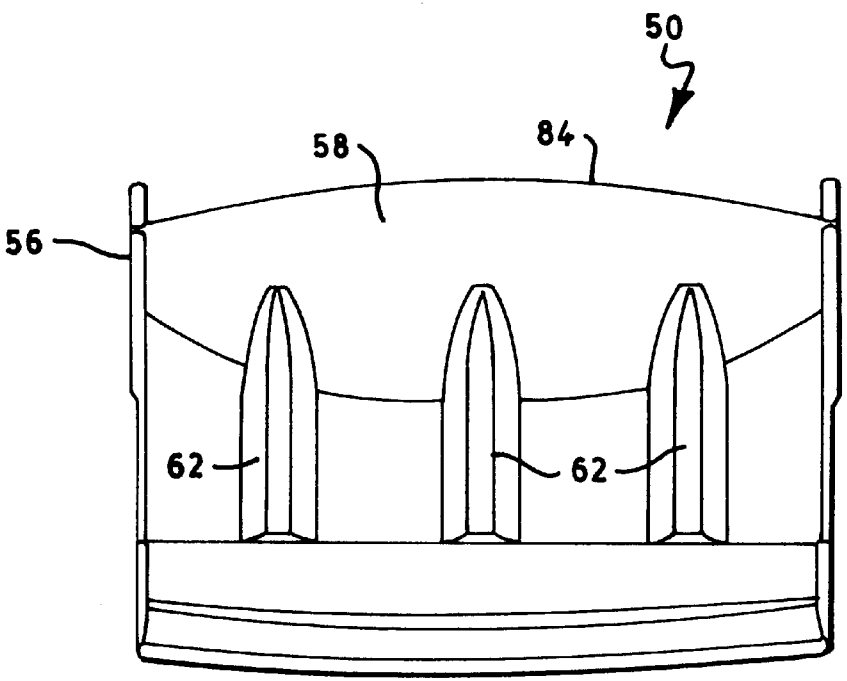
FIG. 11 is a top view of the tray.
Figure 10:
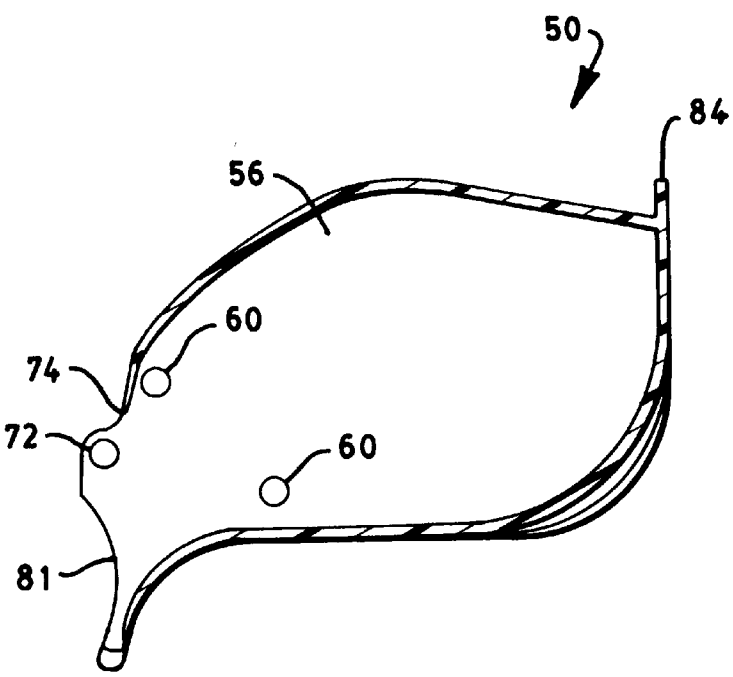
FIG. 10 is a side view of the tray.

As schematically illustrated in FIGS. 9–11, the impingement surface 88 and opening 89 extend adjacent the dispensing rollers 72 when the cover 30 is in a closed position. As seen in FIG. 9, the impingement surface 88 includes a central portion 90 and two outer portions 92 located on opposite sides of the central portion 90. The central portion 90 is located at a first relative position with respect to the dispensing rollers 72 and the gap 94 formed between the rollers 72 through which the wipes are dispensed. The outer portions 92 of the impingement surface 88 are located at different relative positions to the dispensing rollers 72 than the central portion 90. The central portion 90 of the impingement surface 88 may advantageously have a generally rounded or curvilinear shape and be farthest from the gap 94 at the midpoint of the surface 88.

Figure 18:
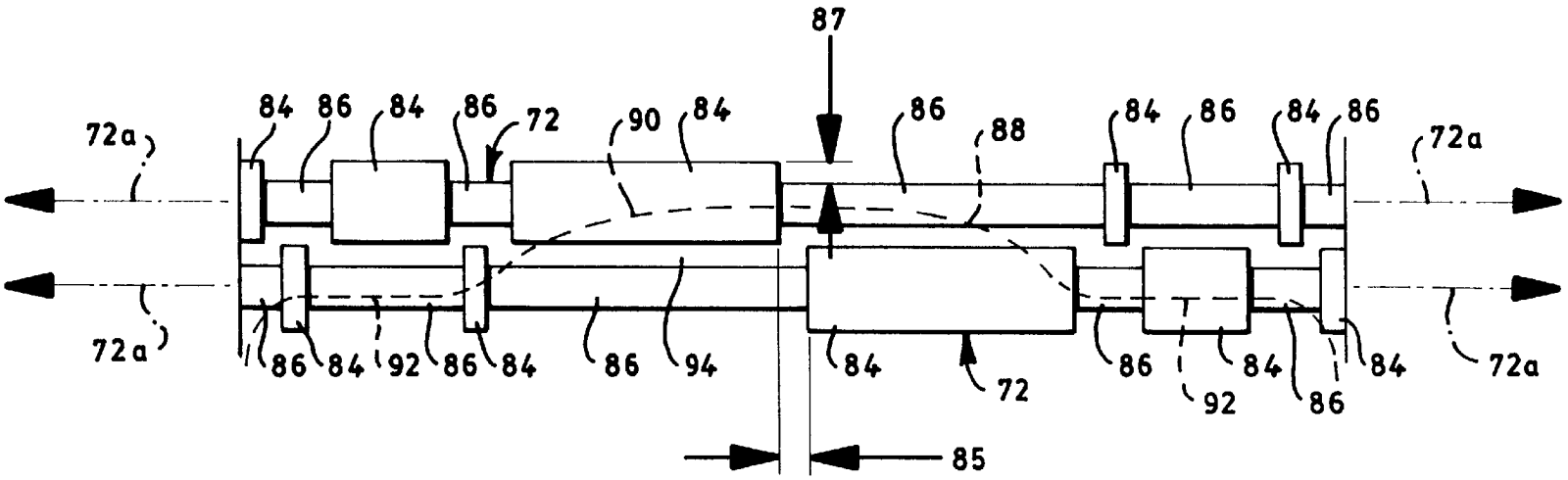
FIG. 18 is a front view of the dispensing rollers.
Figure 21:
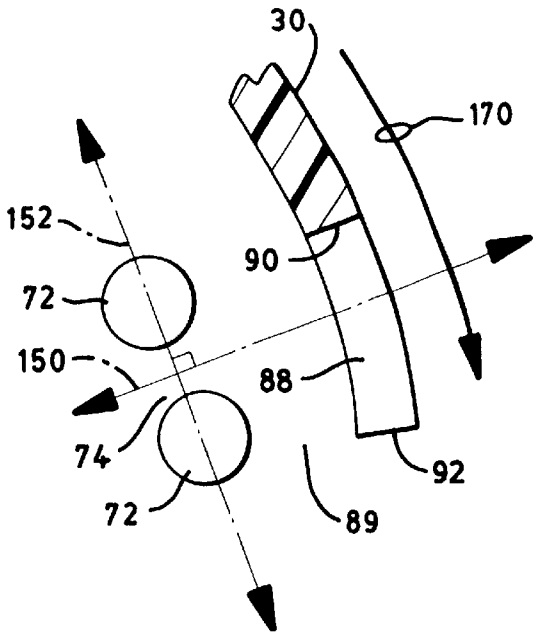
FIG. 21 is another schematic cross sectional view of the dispensing rollers.

With reference to FIGS. 18 and 21, the central portion 90 may be located on one side of the gap 94 and the outer portions 92 are located on the opposite side of the gap 94 when viewing the gap 94 at a normal angle. More specifically, a flat plane 150 intersecting the gap 94 and oriented perpendicularly to a plane 152 connecting the axes 72*a* of the dispenser rollers 72 lies within the dispensing opening 89 adjacent the central portion 90 of the impingement surface 88 while the outer portions 92 of the impingement surface 88 lie on the opposite side of the flat plane 150. Access to the central portion of the gap 94 is relatively unobstructed in such a configuration.

Figure 22:
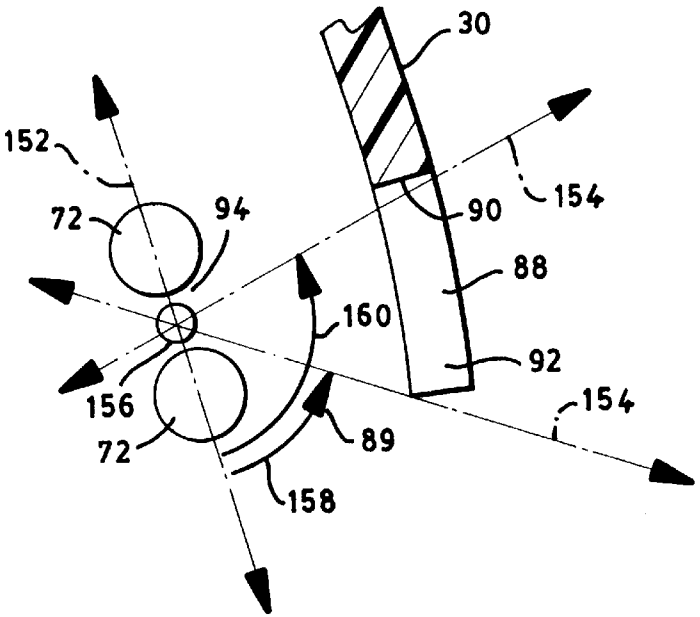
FIG. 22 is another cross sectional view of the dispensing rollers.

With reference to FIG. 22, it can be seen that the illustrated dispensing system includes an impingement surface 88 having a central portion 90 which is disposed relative to the outer portions 92 to provide a more directly accessible gap 94 in the center of the dispensing opening 89. More specifically, a flat plane 154 intersecting the gap 94 and extending through the opening 89 will contact the two outer portions prior to contacting the central portion of the impingement surface when rotated about a line 156 (oriented perpendicular to the view and shown as a point in FIG. 22) of intersection with the gap 94 toward the impingement surface 88. As can be seen in FIG. 22, when rotated from a common location from the opening 89 toward the impingement surface, the plane 154 will rotate an angular distance 158 prior to contacting the outer portions 92 of the impingement surface 88 while the plane 154 must be rotated by a greater angular distance 160 to contact the central portion 90 of the illustrated impingement surface 88.

Figure 19:
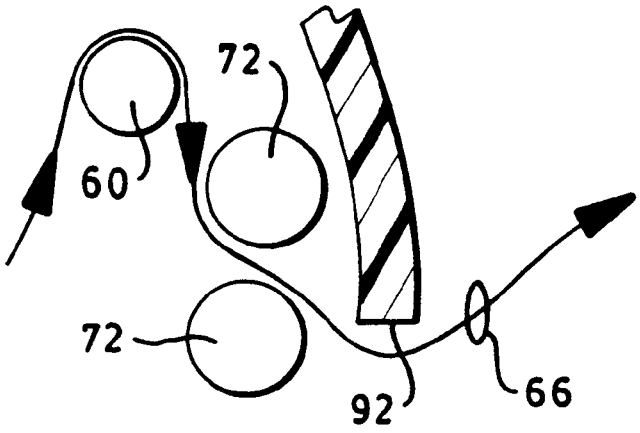
FIG. 19 is a schematic cross sectional view of the outer portion of the dispensing rollers.
Figure 20:
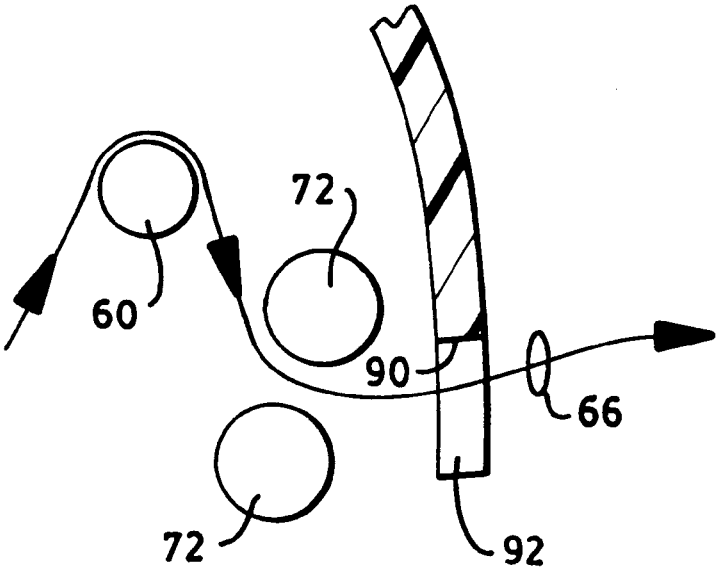
FIG. 20 is a schematic cross sectional view of the central portion of the dispensing rollers.
Figure 23:
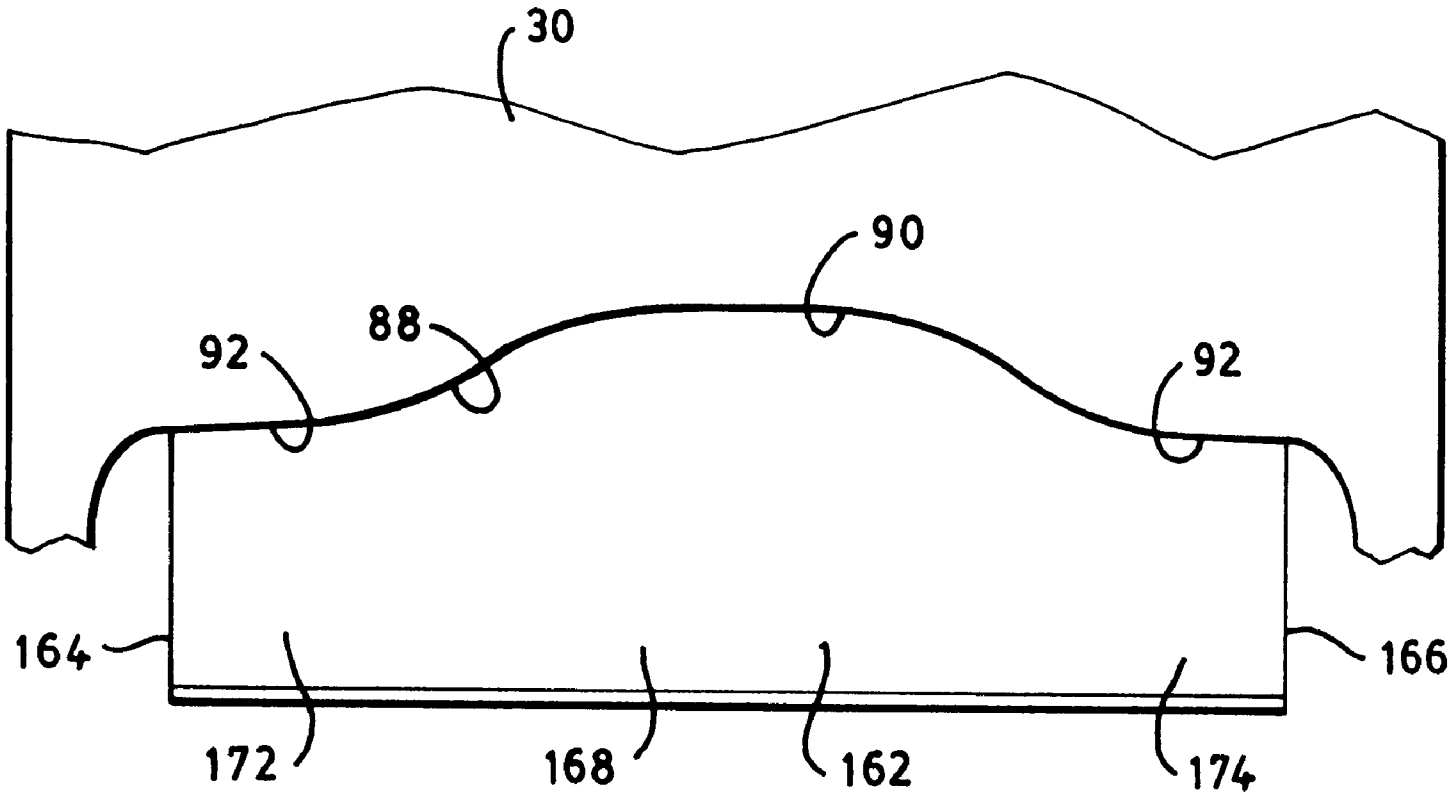
FIG. 23 is a partial view of a dispenser and a wipe.

The dispensing of wipes is best seen in FIGS. 19, 20 and 23. FIGS. 19 and 20 are schematic cross sectional representations which illustrate the direction of travel 66 of a wipe which is being dispensed. FIG. 23 provides a front view of a leading wipe 162 which may be grasped by a user. Each of the individual premoistened wipes provided on roll 22 includes a first side edge 164 and an opposite second side edge 166.

The leading wipe 162 is placed in the gap 94 in a substantially flat configuration when the gap 94 is formed between the two longitudinally extending dispensing rollers 72. This is accomplished in the illustrated embodiment by inserting the tray 50 into the dispenser 20 and closing the cover 30. After loading the premoistened wipes in the dispenser 20, the first and second side edges 164, 166 of the leading wipe 162 are disposed on opposite sides of the gap 94 and a forward edge 168 of the leading wipe 162 extends through the gap 94 where it may be easily grasped and dispensed.

The impingement surface 88 extends into the space through which the wipes are dispensed after passing through the gap 94. The impingement surface 88 extends in a direction 170 (FIG. 21) impinging on the wipe being dispensed. Thus, when the user pulls on the leading wipe to dispense one or more wipes, the impingement surface 88 may be engaged by the leading wipe 162. The wipe engages the outer portions 92 of the impingement surface 88 in first 172 and second 174 areas proximate the first 164 and second 166 side edges of the wipe. The outer portions 92 of the impingement surface 88 extend a greater distance than the central portion 90 in the impingement direction 170. Consequently, during the dispensing process, the outer portions 92 more forcibly engage the wipe than the central portion 90 of the impingement surface 88.

The gap 94 is advantageously sized to be slightly smaller than or approximately equivalent to the thickness of the wipes 22 whereby the wipes will contact both of the dispensing rollers 72 as the wipes pass through the gap 94. The directional lines 66 shown in FIGS. 19 and 20 merely indicate the path of travel of the wipe material without representing the thickness of the wipe.

The outer portions 92 of the impingement surface may thereby provide a bearing surface against which the wipe may be pulled to initiate the separation of the dispensed wipes from the remaining wipes. During the separation process, the wipes are typically subjected to a lateral force which must be resisted to prevent the wipes from "skating" between the dispenser rollers 72 and "bunching up" at one location between the dispenser rollers 72.

The use of dispensing rollers 72 having corresponding lands 84 and grooves 86 provides resistance to the "skating" or "bunching up" of the wipe when the dispensed wipes are separated from the remainder of the premoistened wipes. In the illustrated embodiment, the lands 84 and grooves 86 of the dispensing rollers 72 are coordinated with the outer 92 and central 90 portions of the impingement surface whereby there are more alternations between lands 84 and grooves 86 adjacent the outer portions 92 of the impingement surface 88. As best seen in FIG. 18, the lands 84 and grooves 86 of the illustrated dispensing rollers 72 have a greater average longitudinal length adjacent the central portion 90 of the impingement surface 88 than the outer portions 92 of the impingement surface 88. The shorter average longitudinal length of the lands 84 and grooves 86 adjacent the outer portions 92 of the impingement surface 88 results in a higher concentration of alternations between the lands 84 and grooves 86 adjacent the outer portions 92 of the impingement surface 88.

The alternations between lands 84 and grooves 86 adjacent the outer portions 92 of the impingement surface 88 provide resistance to the "skating" or inward migration of the side edges 164, 166 of the wipe being dispensed. Increasing the number of alternations between the lands 84 and grooves 86 can provide an increased resistance to the skating of the wipe. Providing non-smooth texture, such as knurling, on the dispensing rollers 72 may also provide resistance to the skating of the wipes.

With reference to FIG. 18, when using wipes having a thickness of 0.010 inches (0.025 cm) it has been found advantageous to use dispensing rollers 72 wherein the outside diameter of the lands 84 is 0.380 inches (0.965 cm) and the outside diameter of the grooves 86 is 0.270 inches (0.686 cm). The radial distance 87 (FIG. 18) separating the lands 84 and grooves 86 at a transition point between a land and groove is consequently 0.055 inches (0.140 cm). It has been found advantageous to employ a longitudinal distance 85 separating adjacent transition points on the two dispensing rollers which is three times larger than the distance 87 separating the land and groove surfaces.

The gap 94 is advantageously sized to be smaller than, or approximately equivalent to, the thickness of the wipes 22 whereby the wipes will contact both of the dispensing rollers 72 as the wipes pass through the gap 94. For example, a gap 94 providing a clearance distance of 0.010 inches (0.025 cm) between the dispensing rollers 72 may be used with a wipe having a thickness of 0.015 inches (0.038 cm). It is noted that the directional lines 66 shown in FIGS. 19 and 20 merely indicate the path of travel of the wipe material without representing the thickness of the wipe.

Alternative embodiments of the invention may employ different dimensions for the gap 94, lands 84 and grooves 86. For example, alternative dimensions for the dispensing rollers 72 and gap 94 may be employed with wipes having similar thicknesses. The use of alternative dimensions for the dispensing rollers 72 and gap 94 may also be employed for wipes having different thicknesses. For example, it may be advantageous for wipes having a thickness in the range of 0.300 mm (0.012 inches) to 1.300 mm (0.051 inches) to employ gaps 94 in the range of 0.178 mm (0.007 inches) to 1.17 mm (0.046 inches) wherein the gap size varies linearly with the wipe thickness. These combinations of wipe thickness and gap 94 size are merely illustrative and alternative combinations may also be employed.

Different sized gaps 94 can be easily provided with the same dispenser by exchanging one or both of the dispensing rollers 72. For example, to provide a larger gap 94, the illustrated dispensing rollers 72 could be exchanged for rollers which have lands and grooves with smaller diameters than the illustrated dispensing rollers discussed above. Although rotatable rollers 72 are shown in the representative embodiment, alternative embodiments may employ stationary surface to form a gap 94. Furthermore, by resiliently biasing one of the dispenser rollers towards the second dispenser roller, such as by one or more springs, a dispenser having a variable gap 94 may be provided.

In addition to facilitating the separation of the dispensed wipes, the engagement of a wipe by the outer portions 92 of the impingement surface 88 may also produce a drag on the wipe during the dispensing process. The central portion 90 of the impingement surface 88 may also engage and produce a drag on the wipe. Depending upon the angle at which the wipe is pulled during dispensing, however, the premoistened wipes may not engage the central portion 90 of the impingement surface 88 during the dispensing process.

Some drag is desired during the dispensing process to prevent an excessive quantity of wipes from being dispensed as a result of a minor pulling motion. In the illustrated embodiments, it has been found that an advantageous level of drag can be produced by positioning approximately equal amounts of the impingement surface 88 on opposite sides of flat plane 150.

A mounting device may be used to support the dispenser 20 on a conventional bathroom tissue fixture having a pair of opposed recesses for receiving a telescoping roll bar. A suitable mounting device is described in detail in a commonly assigned U.S. Patent Application entitled "Mounting Device" Ser. No. 09/302,356 filed Apr. 30, 1999, the disclosure of which is hereby incorporated by reference. The disclosures of a commonly assigned U.S. Patent Application entitled "Dispensing System and Method for Premoistened Wipes " Ser. No. 09/302,281 filed Apr. 30, 1999 and a commonly assigned U.S. Provisional Patent Application entitled "Dispenser for Premoistened Wipes" Ser. No. 60/132,024 filed Apr. 30, 1999 are both hereby incorporated by reference.

Figure 13:
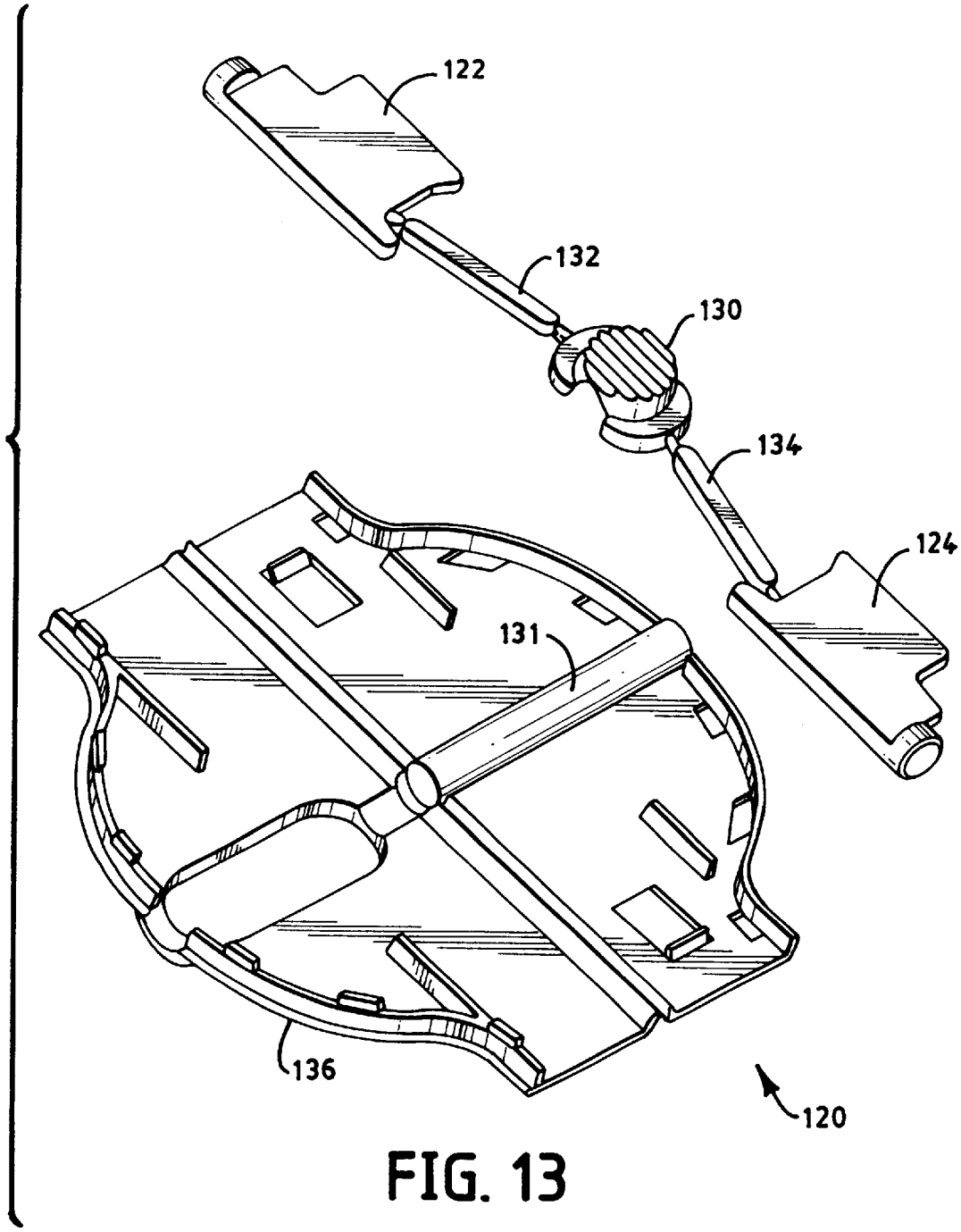
FIG. 13 is an exploded view of a mounting device.
Figure 14:
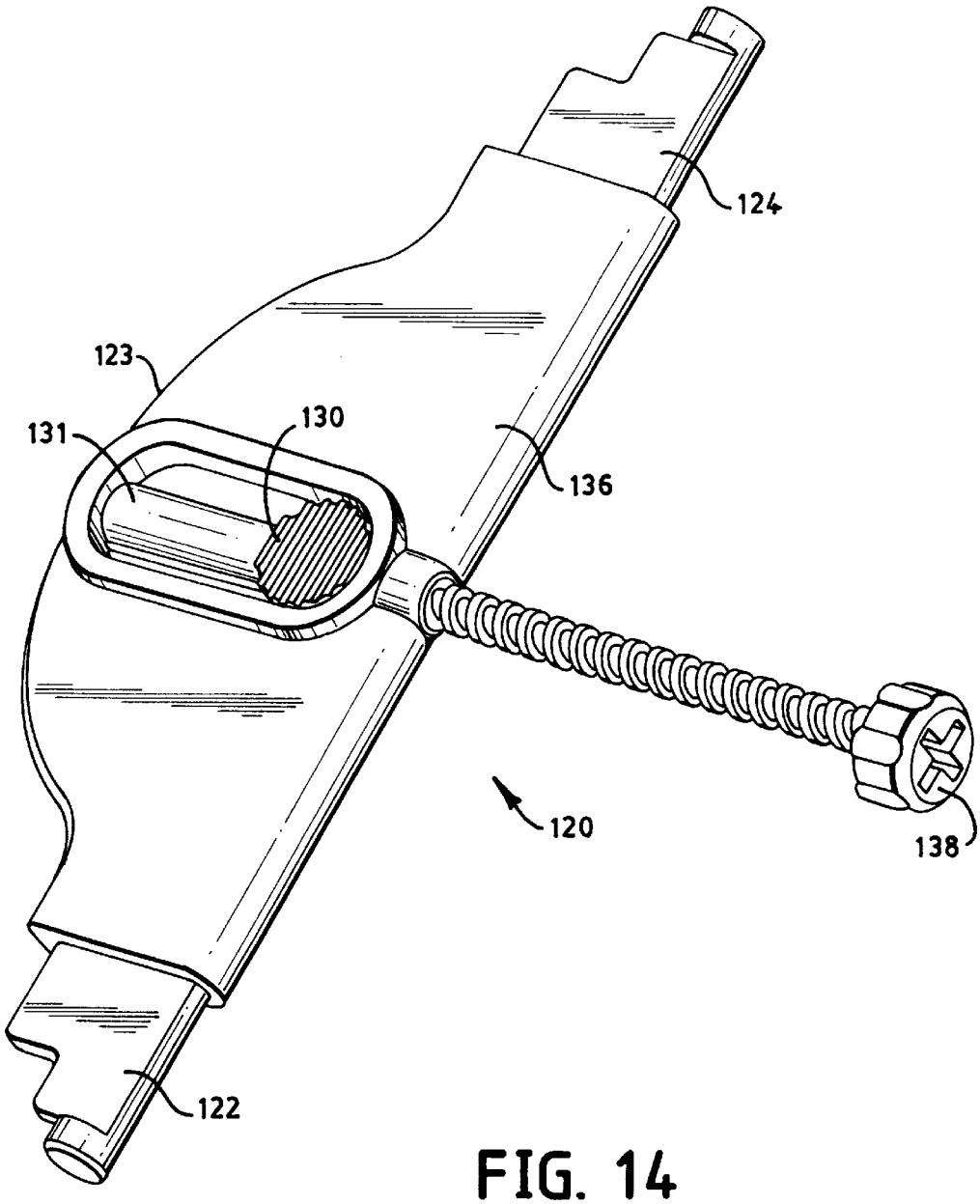
FIG. 14 is a perspective view of a mounting device.
Figure 15:
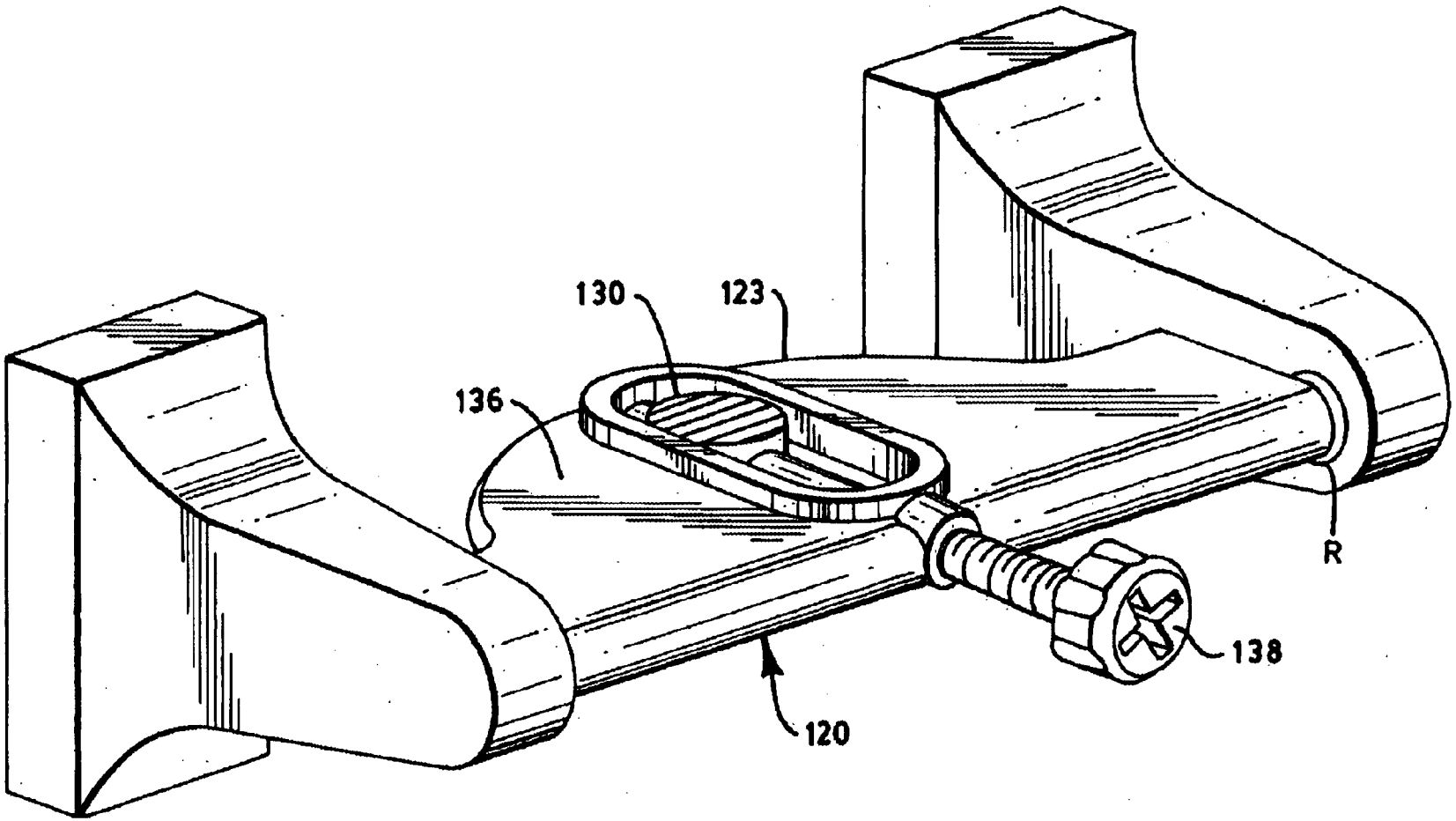
FIG. 15 is a perspective view of a mounting device and a bathroom tissue fixture.

The mounting device 120 illustrated in FIGS. 13–15 includes two support members 122 and 124 which are connected to a positioning member 130 by linkages 132 and 134. As best seen in the exploded view of FIG. 13, the positioning member 130 may be seated over the cylinder 131. The support members 122, 124 are received within the housing 136 and the housing 136 is folded to trap the support members 122, 124 within the housing as illustrated in FIG. 14. A threaded bore hole extends the entire length of cylinder 131 and a threaded fastener 138 may be engaged with the mounting device 120 at either end of the cylinder 131. The threaded fastener 138 may be used to attach the mounting device 120 to a dispenser 20.

As shown in FIG. 15, the mounting device 120 may be used with conventional bathroom tissue fixtures. The user may manually move the positioning member 130 whereby the linkages 132 and 134 force the support members 122, 124 outward to engage the oppositely disposed recesses R of the fixture. The mounting device 120 fits within a slot 121 in the frame 28 and is secured to the frame 28 with fastener 138. To accommodate a wide variety of conventional fixtures, the mounting device 120 can be secured at different positions along slot 121. For recessed fixtures, the mounting device 120 can be turned so that the curved end 123 of the mounting device 120 is inserted first into the slot 121 and the support arms 122, 124 can be located behind the rear surface 100 of the dispenser 20. Alternative mounting devices for attaching the dispenser 20 to a conventional bathroom tissue fixture may also be employed.

Figure 24:
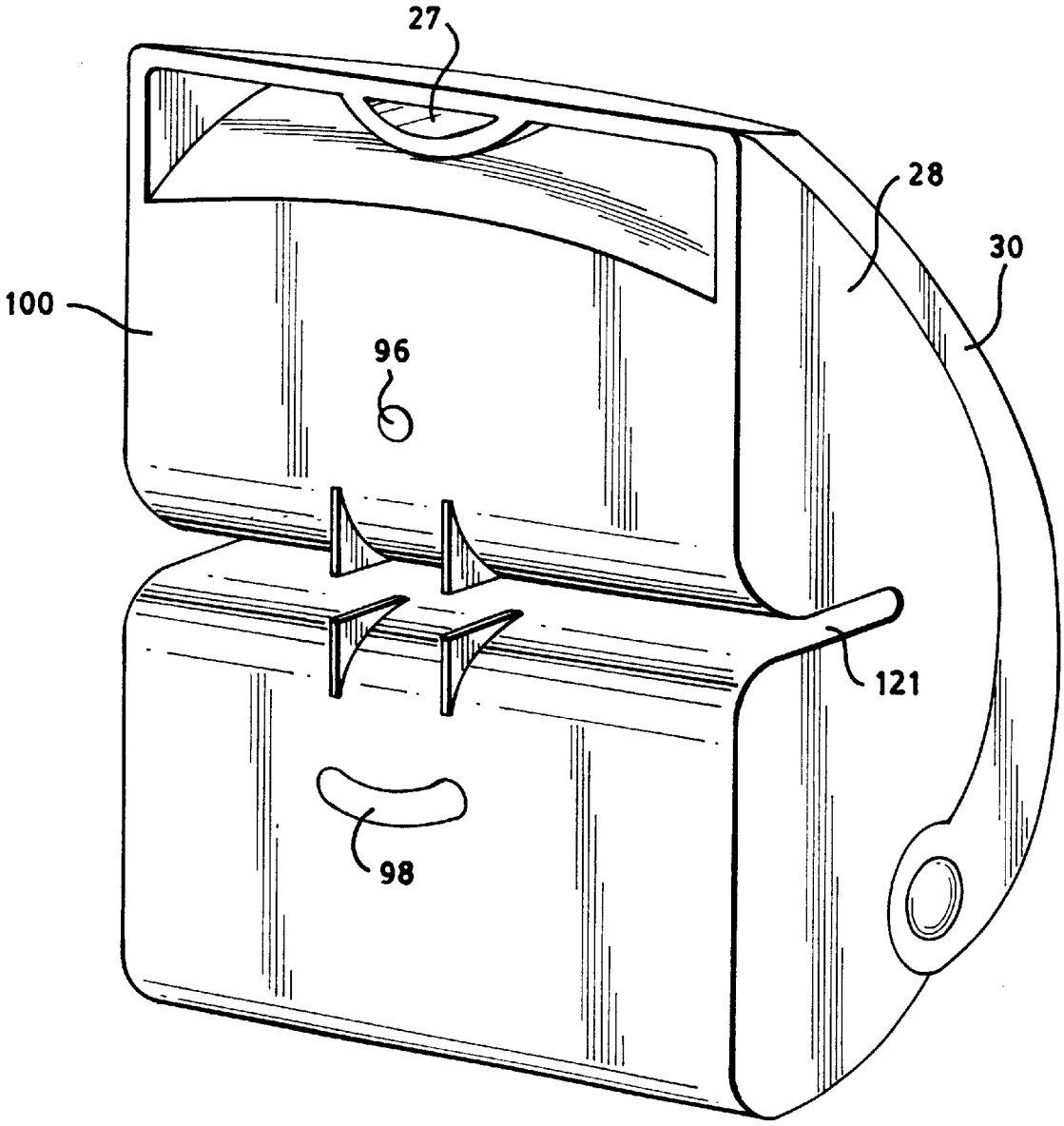
FIG. 24 is a perspective view of the rear of the dispenser.
Figure 25:
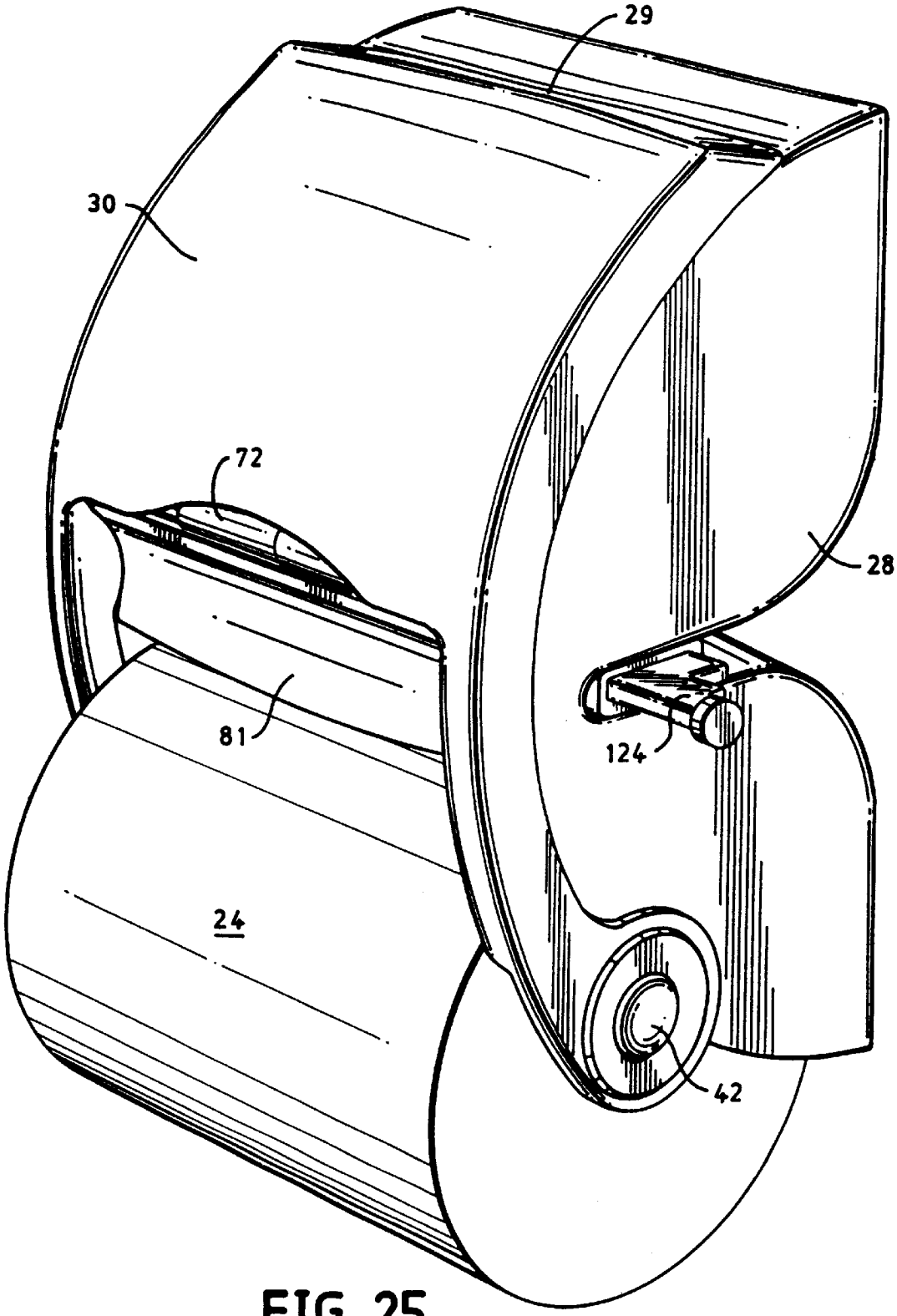
FIG. 25 is a perspective view of an alternative dispenser.
Figure 26:
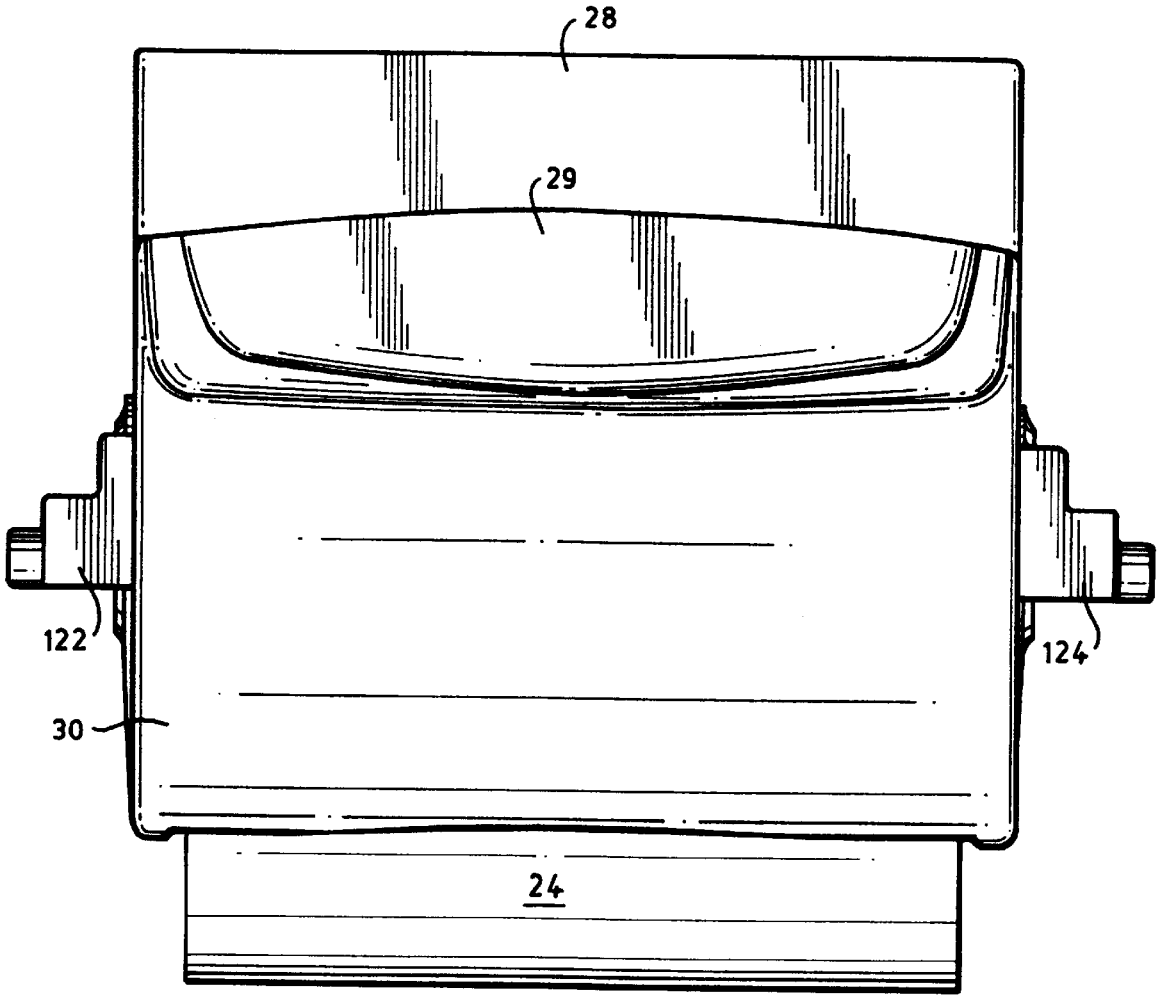
FIG. 26 is a top view of the dispenser of FIG. 25.
Figure 27:
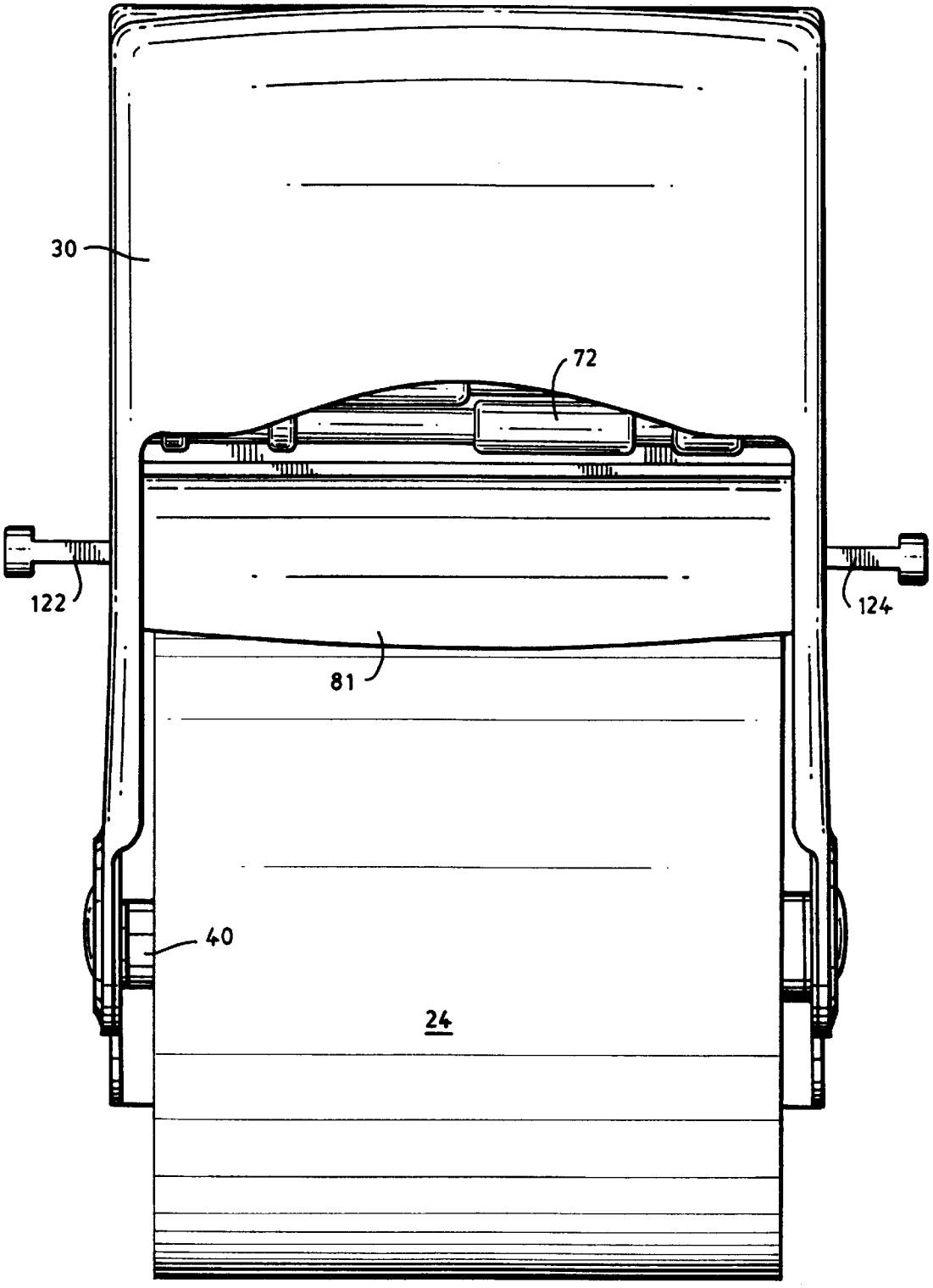
FIG. 27 is a front view of the dispenser of FIG. 25.
Figure 28:
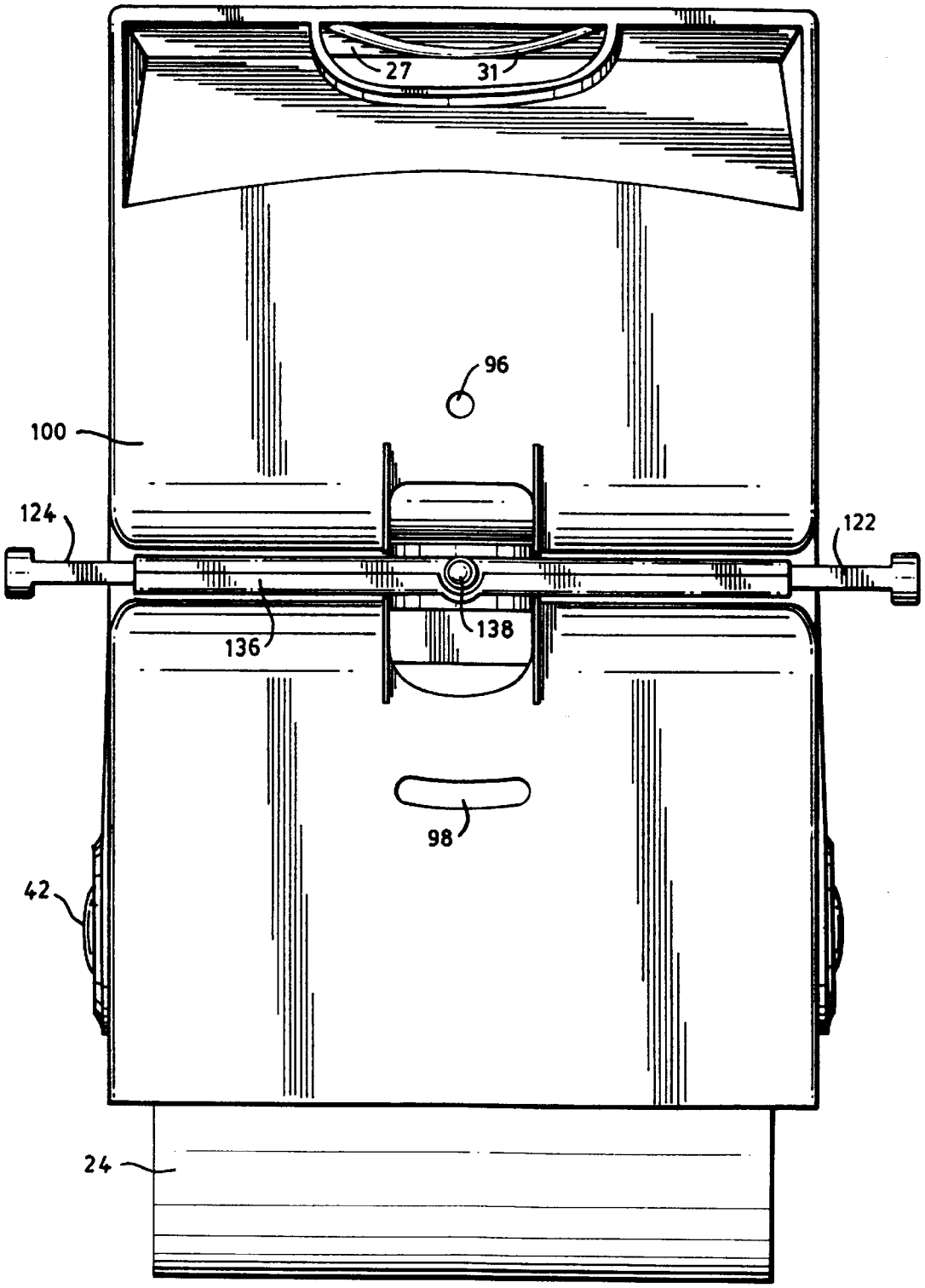
FIG. 28 is a rear view of the dispenser of FIG. 25.
Figure 29:
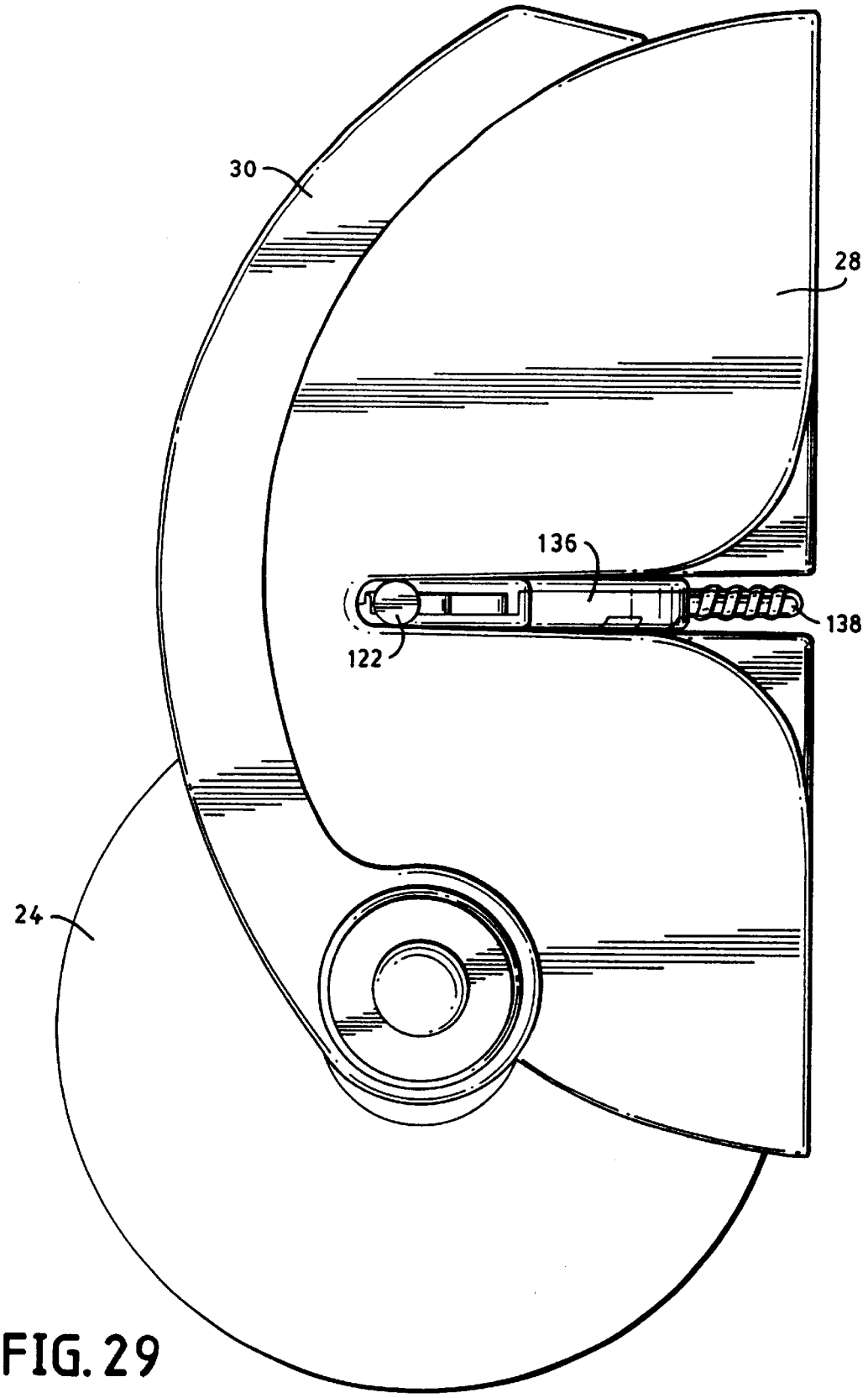
FIG. 29 is a side view of the dispenser of FIG. 25.

The dispenser may also be directly mounted to a wall, cabinet panel or similar support by inserting fasteners through apertures located in the rear surface of the frame 28. The apertures in the rear surface 100 of the frame 28 may include a round aperture 96 adapted to receive a threaded fastener therethrough. The aperture 96 may be advantageously positioned to correspond with the middle rib 62 of the tray whereby the void space defined by the rear of the middle rib 62 will overlay the head of the installed fastener to reduce the possibility of clearance difficulties between the fastener head and the tray. The rear surface of the frame 28 may also include another aperture 98 located below the above-described round aperture as shown in FIG. 24.

While this invention has been described in detail, it will be readily apparent to a person of ordinary skill in the art that various changes and modifications can be made without departing from the spirit and general principles of the invention. All of such changes and modifications are contemplated as being within the scope of the present invention as defined by the subjoined claims. Furthermore, this application is intended to cover such departures from the present disclosure as come within known or customary practice in the art.

What is claimed is:

1. A dispenser for premoistened wipes, said dispenser comprising:

a housing comprising a frame and a cover attached together and enclosing an interior space when the cover is in a closed position, the premoistened wipes being positionable within said interior space and the housing in the closed position being mounted in a vertical orientation to a vertical surface and having a dispensing opening facing away from the vertical surface when so mounted; and a removable tray insertable within the housing, said tray having a liquid retaining receptacle portion and a front wall having a front top surface and a back wall having a back top surface, said receptacle portion positionable below said interior space wherein the tray is positionable within the housing when the housing is mounted in the vertical orientation such that the front top surface of the front wall is located below the back top surface of the back wall and the front top surface is located closer to the dispensing opening than the back top surface is located to the dispensing opening and wherein the premoistened wipes are dispensed out of the dispensing opening by passing up and over the front wall while any excess liquid from the premoistened wipes can collect in the liquid retaining rereptacle portion.

2. The dispenser of claim 1 wherein said removable tray further comprises a raised portion having a support surface for the premoistened wipes.

3. The dispenser of claim 2 wherein said raised portion comprises a plurality of ribs.

4. The dispenser of claim 2 wherein said raised portion comprises a roller.

5. The dispenser of claim 4 wherein said raised portion further comprises a plurality of ribs oriented substantially perpendicular to said roller.

6. The dispenser of claim 1 wherein said tray comprises a pair of oppositely disposed side walls, said pair of side walls connected by a lower surface and a laterally extending wall, said tray including a laterally extending roller disposed opposite said laterally extending wall whereby a substantial portion of said lower surface is disposed between said laterally extending roller and said laterally extending wall.

7. The dispenser of claim 6 wherein said lower surface further comprises a raised portion providing a support surface for the premoistened wipes.

8. The dispenser of claim 7 wherein said raised portion comprises a plurality of ribs oriented substantially perpendicular to said roller.

9. The dispenser of claim 1 wherein said tray further comprises an edge which is engageable with a notch in said housing.

10. The dispenser of claim 1 wherein said tray further comprises a first dispensing roller and said housing further comprises a cover having a second dispensing roller, said cover having an open position wherein said tray is removable from said interior space and a closed position wherein said first and second dispensing rollers are cooperatively positioned to engage one of the premoistened wipes therebetween.

11. The dispenser of claim 10 wherein said tray has a pair of first engagement surfaces located near opposite lateral ends of said first dispensing roller and said cover has a pair of second engagement surfaces located near opposite lateral ends of said second dispensing roller, said pairs of first and second engagement surfaces being engaged together when said cover is in said closed position and thereby aligning said first and second dispensing rollers.

12. The dispenser of claim 10 wherein said cover further comprises a pair of lateral alignment guides projecting therefrom, said tray being disposed between said lateral alignment guides when said cover is in said closed position.

13. The dispenser of claim 1 wherein said tray further comprises a grip projecting from said tray.

14. The dispenser of claim 1 wherein said tray is adapted for receiving a coreless roll of premoistened wipes.

15. The dispenser of claim 1 further comprising a support insertable into a hollow core of a rolled tissue product.

16. The dispenser of claim 1 further comprising a mounting device for supportively engaging said dispenser with a pair of oppositely disposed recesses of a fixture.

17. A dispenser for premoistened wipes, said dispenser comprising:

a housing comprising a frame and a cover attached together and enclosing an interior space when the cover is in a closed position, the wipes premoistened with a solution and being positionable within said interior space and the housing in the closed position being mounted in a vertical orientation to a vertical surface and having a dispensing opening facing away from the vertical surface when so mounted;

a removable tray insertable within the housing, said tray having an impermeable lower surface positionable below said interior space wherein wipes can be dispensed through the dispensing opening without a loss of excess solution from wipes leaving the tray during dispensing of wipes when the housing is in the vertical orientation; and the tray having a front wall with a front top surface and a back wall with a back top surface wherein the front top surface is located below the back top surface when the tray is inserted within the housing and the housing is mounted in the vertical orientation and the front top surface is located closer to the dispensing opening than the back top surface is located to the dispensing opening and wherein the premoistened wipes are dispensed out of the dispensing opening by passing up and over the front wall while any excess liquid from the premoistened wipes can collect on the impermeable lower surface.

18. The dispenser of claim 17 wherein said tray further comprises upwardly extending walls, the premoistened wipes being positionable above said lower surface and inward of said walls.

19. The dispenser of claim 17 wherein said tray further comprises a raised portion having a support surface for the premoistened wipes.

20. The dispenser of claim 19 wherein said raised portion comprises a plurality of ribs.

21. The dispenser of claim 19 wherein said raised portion comprises a laterally extending roller.

22. The dispenser of claim 21 wherein said raised portion further comprises a plurality of ribs oriented substantially perpendicular to said laterally extending roller.

23. The dispenser of claim 17 wherein said tray further comprises an edge which is engageable with a notch in said housing.

24. The dispenser of claim 17 wherein said tray further comprises a first dispensing roller and said housing further comprises a cover having a second dispensing roller, said cover having an open position wherein said tray is removable from said interior space and a closed position wherein said first and second dispensing rollers are cooperatively positioned to engage one of the premoistened wipes therebetween.

25. The dispenser of claim 24 wherein said tray has a pair of first engagement surfaces located near opposite lateral ends of said first dispensing roller and said cover has a pair of second engagement surfaces located near opposite lateral ends of said second dispensing roller, said pairs of first and second engagement surfaces being engaged together when said cover is in said closed position and thereby aligning said first and second dispensing rollers.

26. The dispenser of claim 24 wherein said cover further comprises a pair of lateral alignment guides projecting therefrom, said tray being disposed between said lateral alignment guides when said cover is in said closed position.

27. The dispenser of claim 17 wherein said tray further comprises a grip extending from said tray.

28. The dispenser of claim 17 wherein said tray is adapted for receiving a coreless roll of premoistened wipes.

29. The dispenser of claim 17 further comprising a support insertable into a hollow core of a rolled tissue product.

30. The dispenser of claim 17 further comprising a mounting device for supportively engaging said dispenser with a pair of oppositely disposed recesses.

31. A dispenser comprising:

a housing comprising a frame and a cover attached together and enclosing an interior space when the cover is in a closed position and the housing in the closed position being mounted in a vertical orientation to a vertical surface and having a dispensing opening facing away from the vertical surface when so mounted;

a removable tray insertable within the housing, said tray having a lower surface having a raised portion defining a support surface;

a plurality of wipes premoistened with a solution disposed on said support surface within said interior space wherein wipes can be dispensed through the dispensing opening without a loss of excess solution from wipes leaving the tray during dispensing of wipes when the housing is in the vertical orientation; and the tray having a front wall with a front top surface and a back wall with a back top surface wherein the front top surface is located below the back top surface when the tray is inserted within the housing and the housing is mounted in the vertical orientation and the front top surface is located closer to the dispensing opening than the back top surface is located to the dispensing opening and wherein the premoistened wipes are dispensed out of the dispensing opening by passing up and over the front wall while any excess liquid from the premoistened wipes can collect in a liquid retaining receptacle portion.

32. The dispenser of claim 31 wherein said tray comprises a liquid retaining receptacle portion positioned below said premoistened wipes.

33. The dispenser of claim 31 wherein said lower surface of said tray is a liquid impermeable surface.

34. The dispenser of claim 31 wherein said premoistened wipes are rolled wipes having an axis and said raised portion comprises a plurality of ribs extending substantially perpendicularly to the axis of said rolled wipes.

35. The dispenser of claim 34 wherein said tray further comprises a roller disposed substantially parallel to the axis of said rolled wipes and positioned to engage said rolled wipes.

36. The dispenser of claim 35 wherein said tray further comprises a pair of oppositely disposed side walls, said pair of side walls interconnected by said lower surface and a laterally extending wall, said laterally extending wall disposed opposite said roller whereby said rolled wipes are positioned between said laterally extending wall and said roller.

37. The dispenser of claim 36 wherein at least one of said ribs extends upwardly along said laterally extending wall.

38. The dispenser of claim 31 wherein said tray and wipes are insertable into said interior space as a single unit.

39. The dispenser of claim 31 wherein said plurality of premoistened wipes form a coreless roll of premoistened wipes.

40. A dispenser for premoistened wipes, said dispenser comprising:

a housing comprising a frame and a cover attached together and enclosing an interior space when the cover is in a closed position, the premoistened wipes being positionable within the interior space and the housing in the closed position being mounted in a vertical orientation to a vertical surface and having a dispensing opening facing away from the vertical surface when so mounted; and a removable tray with a front wall having a front top surface and a back wall having a back top surface wherein the wipes are positionable within the tray and the tray and the wipes are positionable within the interior space and when the housing is mounted in the vertical orientation the tray is positioned within the housing and the front top surface of the front wall is located below the back top surface of the back wall and the front top surface is located closer to the dispensing opening than the back top surface is located to the dispensing opening and wherein the premoistened wipes are dispensed out of the dispensing opening by passing up and over the front wall while any excess liquid from the premoistened wipes can collect in a liquid retaining receptacle portion.

41. A dispenser for premoistened wipes, said dispenser comprising:

a housing having an interior space, the premoistened wipes being positionable within said interior space;

a removable tray, said tray having a liquid retaining receptacle portion, said receptacle portion positionable below said interior space; and said tray further comprising a first dispensing roller and said housing further comprising a cover having a second dispensing roller, said cover having an open position wherein said tray is removable from said interior space and a closed position wherein said first and second dispensing rollers are cooperatively positioned to engage one of the premoistened wipes therebetween.

42. The dispenser of claim 41 wherein said tray has a pair of first engagement surfaces located near opposite lateral ends of said first dispensing roller and said cover has a pair of second engagement surfaces located near opposite lateral ends of said second dispensing roller, said pairs of first and second engagement surfaces being engaged together when said cover is in said closed position and thereby aligning said first and second dispensing rollers.

43. The dispenser of claim 41 wherein said cover further comprises a pair of lateral alignment guides projecting therefrom, said tray being disposed between said lateral alignment guides when said cover is in said closed position.

44. A dispenser for premoistened wipes, said dispenser comprising:

a housing having an interior space, the premoistened wipes being positionable within said interior space;

a removable tray, said tray having an impermeable lower surface positionable below said interior space; and said tray further comprising a first dispensing roller and said housing further comprising a cover having a second dispensing roller, said cover having an open position wherein said tray is removable from said interior space and a closed position wherein said first and second dispensing rollers are cooperatively positioned to engage one of the premoistened wipes therebetween.

45. The dispenser of claim 44 wherein said tray has a pair of first engagement surfaces located near opposite lateral ends of said first dispensing roller and said cover has a pair of second engagement surfaces located near opposite lateral ends of said second dispensing roller, said pairs of first and second engagement surfaces being engaged together when said cover is in said closed position and thereby aligning said first and second dispensing rollers.

46. The dispenser of claim 44 wherein said cover further comprises a pair of lateral alignment guides projecting therefrom, said tray being disposed between said lateral alignment guides when said cover is in said closed position.

* * * * *